US009557671B2

(12) United States Patent
Chiba et al.

(10) Patent No.: US 9,557,671 B2
(45) Date of Patent: Jan. 31, 2017

(54) ELECTROSTATIC IMAGE DEVELOPING TONER, DEVELOPER, AND IMAGE FORMING APPARATUS

(71) Applicants: Ryuta Chiba, Kanagawa (JP); Shinya Nakayama, Shizuoka (JP); Hiroshi Yamada, Shizuoka (JP); Minoru Masuda, Shizuoka (JP); Akinori Saitoh, Shizuoka (JP); Hideyuki Santo, Kanagawa (JP); Shinsuke Nagai, Shizuoka (JP); Akihiro Takeyama, Kanagawa (JP); Hiroyuki Takeda, Kanagawa (JP); Tsuyoshi Sugimoto, Shizuoka (JP); Suzuka Amemori, Shizuoka (JP); Kohsuke Nagata, Shizuoka (JP)

(72) Inventors: Ryuta Chiba, Kanagawa (JP); Shinya Nakayama, Shizuoka (JP); Hiroshi Yamada, Shizuoka (JP); Minoru Masuda, Shizuoka (JP); Akinori Saitoh, Shizuoka (JP); Hideyuki Santo, Kanagawa (JP); Shinsuke Nagai, Shizuoka (JP); Akihiro Takeyama, Kanagawa (JP); Hiroyuki Takeda, Kanagawa (JP); Tsuyoshi Sugimoto, Shizuoka (JP); Suzuka Amemori, Shizuoka (JP); Kohsuke Nagata, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 4 days.

(21) Appl. No.: 14/629,954

(22) Filed: Feb. 24, 2015

(65) Prior Publication Data

US 2015/0248070 A1 Sep. 3, 2015

(30) Foreign Application Priority Data

Mar. 3, 2014 (JP) ..... 2014-040480
Jul. 14, 2014 (JP) ..... 2014-143975
Feb. 2, 2015 (JP) ..... 2015-018159

(51) Int. Cl.
*G03G 9/087* (2006.01)
*G03G 9/09* (2006.01)

(52) U.S. Cl.
CPC ..... *G03G 9/08755* (2013.01); *G03G 9/08782* (2013.01); *G03G 9/08795* (2013.01); *G03G 9/08797* (2013.01); *G03G 9/0906* (2013.01)

(58) Field of Classification Search
CPC ..... G03G 9/091; G03G 9/08755
See application file for complete search history.

(56) References Cited

U.S. PATENT DOCUMENTS 5,721,083 A 2/1998 Masuda et al.
7,374,851 B2 5/2008 Nakayama et al.
(Continued)

FOREIGN PATENT DOCUMENTS

JP 2004-046095 A 2/2004
JP 2007-271789 A 10/2007
(Continued)

OTHER PUBLICATIONS

U.S. Appl. No. 14/289,581, filed May 29, 2014.

*Primary Examiner* — Peter Vajda
(74) *Attorney, Agent, or Firm* — Oblon, McClelland, Maier & Neustadt, L.L.P.

(57) ABSTRACT

A toner, including: base particles containing a polyester resin, a colorant, and a release agent, wherein the toner has a glass transition temperature (Tg1st) of 20° C. to 50° C. where the glass transition temperature (Tg1st) is measured in first heating of differential scanning calorimetry (DSC) of
(Continued)

the toner, wherein tetrahydrofuran (THF) insoluble matter of the toner has a glass transition temperature [Tg2nd (THF insoluble matter)] of 30° C. or lower where the glass transition temperature [Tg2nd (THF insoluble to matter)] is measured in second heating of differential scanning calorimetry (DSC) of the THF insoluble matter, and wherein 50% or less of the colorant is present within a region of 1,000 nm from a surface of each of the base particles toward a center thereof.

17 Claims, 1 Drawing Sheet

(56) References Cited

U.S. PATENT DOCUMENTS

| | | | | |
|---|---|---|---|---|
| 8,084,176 | B2 | 12/2011 | Iwamoto et al. | |
| 2004/0115551 | A1 | 6/2004 | Sugiyama et al. | |
| 2005/0064310 | A1 | 3/2005 | Masuda et al. | |
| 2005/0112488 | A1 | 5/2005 | Yamada et al. | |
| 2008/0118855 | A1 | 5/2008 | Nakayama et al. | |
| 2008/0213682 | A1 | 9/2008 | Saitoh et al. | |
| 2008/0233498 | A1 | 9/2008 | Yamada et al. | |
| 2008/0261131 | A1 | 10/2008 | Nakayama et al. | |
| 2008/0268366 | A1 | 10/2008 | Nakayama et al. | |
| 2008/0280219 | A1 | 11/2008 | Nakayama et al. | |
| 2008/0318143 | A1 | 12/2008 | Nakayama et al. | |
| 2009/0117480 | A1 | 5/2009 | Yamada et al. | |
| 2009/0123857 | A1* | 5/2009 | Shu | G03G 9/091 430/107.1 |
| 2009/0142682 | A1 | 6/2009 | Saitoh et al. | |
| 2009/0280421 | A1 | 11/2009 | Awamura et al. | |
| 2010/0129748 | A1 | 5/2010 | Inoue et al. | |
| 2010/0173243 | A1 | 7/2010 | Maekawa et al. | |
| 2011/0223530 | A1 | 9/2011 | Inoue et al. | |
| 2011/0281213 | A1 | 11/2011 | Sakashita et al. | |
| 2011/0294058 | A1 | 12/2011 | Shiba et al. | |
| 2012/0052434 | A1* | 3/2012 | Sugimoto | G03G 9/0806 430/108.8 |
| 2012/0070777 | A1 | 3/2012 | Makabe et al. | |
| 2012/0264049 | A1 | 10/2012 | Masuda et al. | |
| 2012/0270147 | A1 | 10/2012 | Katoh et al. | |
| 2012/0282000 | A1 | 11/2012 | Nakayama et al. | |
| 2013/0045442 | A1 | 2/2013 | Moriya et al. | |
| 2013/0078563 | A1 | 3/2013 | Nakayama et al. | |
| 2013/0095422 | A1 | 4/2013 | Yamamoto et al. | |
| 2013/0108950 | A1 | 5/2013 | Yamamoto et al. | |
| 2013/0115550 | A1 | 5/2013 | Amemori et al. | |
| 2013/0143155 | A1 | 6/2013 | Santo et al. | |
| 2013/0157183 | A1 | 6/2013 | Santo et al. | |
| 2013/0157185 | A1 | 6/2013 | Sakashita et al. | |
| 2013/0236826 | A1 | 9/2013 | Makabe et al. | |
| 2013/0244011 | A1 | 9/2013 | Sabu et al. | |
| 2013/0244153 | A1 | 9/2013 | Nakayama et al. | |
| 2013/0244154 | A1 | 9/2013 | Yamamoto et al. | |
| 2013/0244168 | A1 | 9/2013 | Yamashita et al. | |
| 2013/0252158 | A1 | 9/2013 | Yamada et al. | |
| 2013/0260298 | A1 | 10/2013 | Amemori et al. | |
| 2013/0273188 | A1 | 10/2013 | Takahashi et al. | |
| 2014/0038100 | A1 | 2/2014 | Katoh et al. | |
| 2014/0051019 | A1 | 2/2014 | Sekiguchi et al. | |
| 2014/0065534 | A1 | 3/2014 | Amemori et al. | |
| 2014/0141110 | A1 | 5/2014 | Katoh et al. | |
| 2014/0242514 | A1 | 8/2014 | Inoue et al. | |
| 2014/0270874 | A1 | 9/2014 | Hase et al. | |
| 2014/0272695 | A1 | 9/2014 | Moritani et al. | |
| 2014/0272696 | A1 | 9/2014 | Yamashita et al. | |
| 2014/0301757 | A1 | 10/2014 | Sakashita et al. | |
| 2014/0342283 | A1 | 11/2014 | Yamamoto et al. | |

FOREIGN PATENT DOCUMENTS

| | | | |
|---|---|---|---|
| JP | 4079257 | B2 | 2/2008 |
| JP | 2011-203704 | A | 10/2011 |
| JP | 2015-052697 | A | 3/2015 |

* cited by examiner

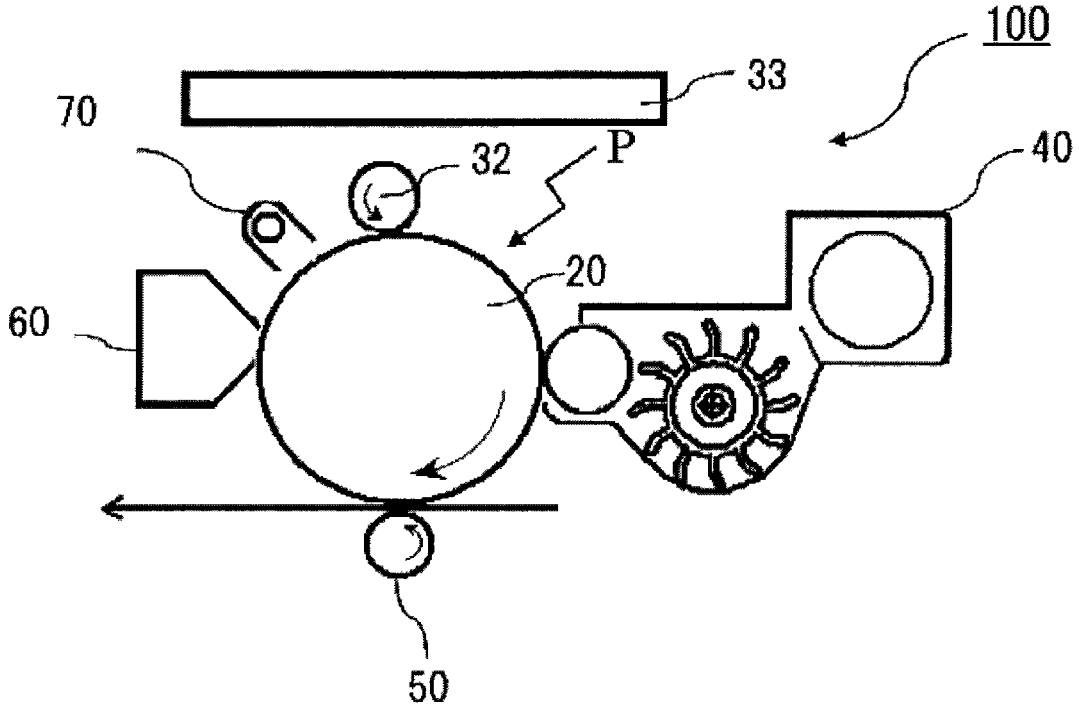
100
33
70
32
P
40
20
60
50

ELECTROSTATIC IMAGE DEVELOPING TONER, DEVELOPER, AND IMAGE FORMING APPARATUS

BACKGROUND OF THE INVENTION

Field of the Invention

The present invention relates to an electrostatic image developing toner, a developer, and an image forming apparatus.

Description of the Related Art

In order to obtain an electrostatic image developing toner having a high level of low temperature fixing ability, a toner is proposed that contains: a resin containing a crystalline polyester resin; and a release agent, and has a phase separation structure in a sea-island form formed due to incompatibility between the resin and wax (see, for example, Japanese Patent Application Laid-Open (JP-A) No. 2004-46095).

Also, another toner is proposed that contains a crystalline polyester resin, a release agent, and a graft polymer (see, for example, JP-A No. 2007-271789).

According to these proposed techniques, the crystalline polyester resin melts more rapidly at temperatures than a non-crystalline polyester resin to thereby achieve lowered fixing temperature.

Also, in view of the recent demand for further increase in quality, a toner has been required that has high levels of all of low temperature fixing ability, heat resistant storage stability, and image quality.

As seen in Japanese Patent (JP-B) No. 4079257, one general technique used for attempting to obtain high image quality by dispersing a pigment is uniformly dispersing the pigment inside toner base particles using a pigment dispersing agent.

In addition, there is a disclosed technique of preventing a pigment from being localized on the toner surface by previously treating the pigment surface with a poorly soluble resin to reduce activity of the pigment during granulation of the toner in chemical processes (JP-A No. 2011-203704).

SUMMARY OF THE INVENTION

The present invention aims to solve the above problems pertinent in the art and achieve an object of providing a toner having high levels of all of low temperature fixing ability, heat resistant storage stability, and image quality by controlling the state of the pigment in toner particles (hereinafter may be referred to simply as "base particles") to uniformly disperse the pigment therein.

In order to solve the above problems, the present inventors have completed an invention of "electrostatic image developing toner" described in (1) below.

(1) "A toner, including: base particles containing a polyester resin, a colorant, and a release agent, wherein the toner has a glass transition temperature (Tg1st) of 20° C. to 50° C. where the glass transition temperature (Tg1st) is measured in first heating of differential scanning calorimetry (DSC) of the toner, wherein tetrahydrofuran (THF) insoluble matter of the toner has a glass transition temperature [Tg2nd (THF insoluble matter)] of 30° C. or lower where the glass transition temperature [Tg2nd (THF insoluble matter)] is measured in second heating of differential scanning calorimetry (DSC) of the THF insoluble matter, and wherein 50% or less of the colorant is present within a region of 1,000 nm from a surface of each of the base particles toward a center thereof."

As understood from the following detailed description, the present invention has a remarkably excellent effect of providing an electrophotographic toner having high levels of all of low temperature fixing ability, heat resistant storage stability, and image quality.

BRIEF DESCRIPTION OF THE DRAWINGS

FIG. 1 illustrates one example of an image forming apparatus of the present invention.

DETAILED DESCRIPTION OF THE INVENTION

Hereinafter, the present invention will be described in detail.

The present invention relates to "toner" described in (1) above. As understood from the following detailed description, however, this "toner" encompasses toners according to embodiments described in (2) to (9) below and the present invention also encompasses "developer" and "image forming apparatus" described in (10) and (11) below. Hence, these will be described in detail as well.

(2) The toner according to (1) above, wherein the base particles further contain a colorant dispersing resin and wherein a solution containing the colorant dispersing resin dissolved in ethyl acetate so as to have a solid content of 20% by mass satisfies the following expressions: T(60)%−T(480)%≥30%, and T(480)% is 50% or less, where the T(60)% is a transmittance of the solution containing the colorant dispersing resin dissolved in ethyl acetate at an optical path length of 1 cm after the solution has been left for 60 minutes, and the T(480)% is a transmittance of the solution containing the colorant dispersing resin dissolved in ethyl acetate at an optical path length of 1 cm after the solution has been left for 480 minutes.

(3) The toner according to (1) or (2) above, wherein the T(60)% is 30% or more.

(4) The toner according to any one of (1) to (3) above, wherein an amine value of the colorant is 2 mgKOH/g or less.

(5) The toner according to any one of (1) to (4) above, wherein the colorant contains at least Pigment Red 269.

(6) The toner according to any one of (1) to (5) above, wherein [G'(100) (THF insoluble matter)] is $1.0\times10^5$ Pa to $1.0\times10^7$ Pa where the [G'(100) (THF insoluble matter)] is a storage modulus at 100° C. of the THF insoluble matter.

(7) The toner according to any one of (1) to (6) above, wherein a ratio of [G'(40) (THF insoluble matter)] to the [G(100) (THF insoluble matter)], which is represented by [G'(40) (THF insoluble matter)]/[G'(100) (THF insoluble matter)], is 3.5×10 or less, where the [G'(40) (THF insoluble matter)] is a storage modulus at 40° C. of the THF insoluble matter and the [G'(100) (THF insoluble matter)] is a storage modulus at 100° C. of the THF insoluble matter.

(8) The toner according to any one of (1) to (7) above, wherein the toner has a glass transition temperature (Tg2nd) of 0° C. to 30° C. where the glass transition temperature (Tg2nd) is measured in second heating of differential scanning calorimetry (DSC) of the toner.

(9) The toner according to any one of (1) to (8) above, wherein the [G'(100) (THF insoluble matter)], which is the storage modulus at 100° C. of the THF insoluble matter, is $5.0\times10^5$ Pa to $5.0\times10^6$ Pa.

(10) The toner according to any one of (1) to (9) above, wherein the polyester resin contains a crystalline polyester resin, a non-crystalline polyester resin A containing a crosslinked structure, and a non-crystalline polyester resin B having a higher Tg than the non-crystalline polyester resin A.

(11) A developer, including: the toner according to any one of (1) to (10) above; and a carrier.

(12) An image forming apparatus, including: an electrostatic latent image bearer; an electrostatic latent image forming unit configured to form an electrostatic latent image on the electrostatic latent image bearer; and a developing unit containing a toner and configured to develop the electrostatic latent image formed on the electrostatic latent image bearer with the toner to form a visible image, wherein the toner is the toner according to any one of (1) to (11) above.

<THF Insoluble Matter>

The THF insoluble matter is a non-crystalline polyester resin insoluble in THF (tetrahydrofuran) (preferably the non-crystalline polyester resin A), having certain rubber elasticity.

The glass transition temperature [Tg2nd (THF insoluble matter)] of the THF insoluble matter, which is measured in second heating of differential scanning calorimetry (DSC) of the THF insoluble matter, is 30° C. or less.

Also, when the [G'(100) (THF insoluble matter)] is $1.0\times10^7$ Pa or less, the toner of the present invention can rapidly be fixed at low temperature. In addition, the toner having the G' of $1.0\times10^5$ Pa or more can also satisfy relatively easily and surely heat resistant storage stability (aggregation resistance) at normal temperature.

Further, by using, as a binder resin, the non-crystalline polyester resin being insoluble in THF and having the aforementioned rubber elasticity, in combination with a resin having high compatibility therewith (for example, the below-described crystalline polyester resin C typically), it has been found that the non-crystalline polyester resin insoluble in THF itself exhibits very high elasticity in the normal temperature range to the fixing temperature range, but the resultant toner is lowered in elasticity in the fixing temperature range while maintaining high elasticity in the normal temperature to the storage temperature range.

When the above toner contains the THF insoluble matter in a specific amount, the toner has a lower Tg than the conventional toners but can sufficiently retain heat resistant storage stability. In particular, the non-crystalline polyester resin has a urethane bond or a urea bond responsible for high aggregation force, the effect of retaining heat resistant storage stability will be more significant. An amount of the tetrahydrofuran (THF) insoluble matter in the toner is not particularly limited and may be appropriately selected depending on the intended purpose, but is preferably 15% by mass to 35% by mass, more preferably 20% by mass to 30% by mass. When the THF insoluble matter is less than 15% by mass, the resultant toner may be reduced in low temperature fixing ability, whereas when it is more than 35% by mass, the resultant toner may be degraded in heat resistant storage stability.

The THF insoluble matter of the toner can be obtained as follows.

Specifically, 1 part of the toner is added to 40 parts of tetrahydrofuran (THF) (unless otherwise specified, "part(s)" indicate "part(s) by mass" in the present specification). The mixture is refluxed for 6 hours. Thereafter, insoluble matter is precipitated with a centrifugal separator, and the supernatant is separated from the insoluble matter.

The insoluble matter is then dried at 40° C. for 20 hours to thereby obtain the THF insoluble matter.

<Glass Transition Temperature>

<<[Tg1st (Toner)]>>

The toner has the glass transition temperature [Tg1st (toner)] of 20° C. to 50° C., more preferably 35° C. to 45° C., where the glass transition temperature [Tg1st (toner)] is measured in first heating of differential scanning calorimetry (DSC).

If the Tg of a conventional toner is lowered to be about 50° C. or lower, the conventional toner tends to cause aggregation of toner particles influenced by temperature variations during transportation or storage of the toner in summer or in a tropical region.

As a result, the toner is solidified in a toner bottle, or within a developing unit. Moreover, supply failures due to clogging of the toner in the toner bottle, and formation of defected images due to toner adherence are likely to occur.

The toner of the present invention has a lower Tg than conventional toners. The toner of the present invention, however, can maintain its heat resistant storage stability. In particular, when the non-crystalline polyester resin has a urethane bond or a urea bond responsible for high aggregation force, the effect of retaining heat resistant storage stability will be more significant.

When the [Tg1st (toner)] is lower than 20° C., the toner has poor heat resistant storage stability, causes blocking within a developing unit, and causes filming on a photoconductor. When it is higher than 50° C., the toner has poor low temperature fixing ability.

<<[Tg2nd (Toner)]>>

The [Tg2nd (toner)] of the toner, which is the glass transition temperature measured in second heating of differential scanning calorimetry (DSC), is not particularly limited and may be appropriately selected depending on the intended purpose. It is preferably 0° C. to 30° C., more preferably 15° C. to 30° C.

When the [Tg2nd (toner)] is lower than 0° C., the fixed image (printed matter) may be degraded in blocking resistance, whereas when it is higher than 30° C., sufficient low temperature fixing ability and glossiness may not be obtained.

The [Tg2nd (toner)] can be adjusted by, for example, the Tg and amount of the crystalline polyester resin.

<Storage Modulus Ratio>

<<[G'(100) (THF Insoluble Matter)] and [[G'(40) (THF Insoluble Matter)]/[G'(100) (THF Insoluble Matter)]]>>

As described above, the storage modulus at 100° C. of the THF insoluble matter of the toner of the present invention, [G'(100) (THF insoluble matter)], is $1.0\times10^5$ Pa to $1.0\times10^7$ Pa, but it is preferably $5.0\times10^5$ Pa to $5.0\times10^6$ Pa. The rubber elasticity of the toner heated to 100° C. rapidly decreases as compared with that of the toner heated to 40° C., and thus the toner can have higher levels of rapid fixing ability at low temperatures and heat resistant storage stability (aggregation resistance).

The ratio of the storage modulus at 40° C. of the THF insoluble matter of the toner of the present invention; i.e., [[G'(40) (THF insoluble matter)], to the storage modulus at 100° C. of the THF insoluble matter of the toner of the present invention; i.e., [G'(100) (THF insoluble matter)], which is represented by [[G'(40) (THF insoluble matter)]/[G'(100) (THF insoluble matter)]], is 3.5×10 or less, but it is preferably 3.3×10 or less. The lower limit of the above ratio [[G'(40) (THF insoluble matter)]/[G'(100) (THF insoluble matter)]] is not particularly limited and may be appropriately selected depending on the intended purpose, but the ratio

[[G'(40) (THF insoluble matter)]/[G'(100) (THF insoluble matter)]] is preferably 2.0×10 or more.

Also, when the [G'(100) (THF insoluble matter)] is $1.0\times10^5$ Pa to $1.0\times10^7$ Pa and the above ratio [[G'(40) (THF insoluble matter)]/[G'(100) (THF insoluble matter)]] is 3.5×10 or less, the above toner has such a low storage modulus G' and promotes compatibility between the crystalline polyester resin and the non-crystalline polyester resin which is a high Tg component, so that a ½ flow onset temperature as measured with a thermal flow evaluator (flow tester) decreases, and image gloss is improved even in fixing at low temperatures.

<<Measurement Method of Storage Modulus (G')>>

Storage moduli (G') under various conditions can be measured using, for example, a dynamic viscoelasticity measuring device (ARES, product of TA instruments). A frequency during measurement is 1 Hz.

Specifically, the measuring method of storage modulus (G') is described as follows. A measurement sample is molded into a pellet having a diameter of 8 mm and a thickness of 1 mm to 2 mm. Then, the resultant is fixed on a parallel plate having a diameter of 8 mm, allowed to stabilize at 40° C., and allowed to rise in temperature to 200° C. at frequency: 1 Hz (6.28 rad/s), strain amount: 0.1% (controlled strain mode), and heating rate: 2.0° C./min.

In the present specification, the storage modulus at 40° C. may be denoted by G'(40° C.) and the storage modulus at 100° C. may be denoted by G'(100° C.).

[Properties of Toner]

<Melting Point>

The melting point of the toner is not particularly limited and may be appropriately selected depending on the intended purpose. It is preferably 60° C. to 80° C.

<Volume Average Particle Diameter>

The volume average particle diameter of the toner is not particularly limited and may be appropriately selected depending on the intended purpose, but it is preferably 3 μm to 7 μm. Moreover, a ratio of the volume average particle diameter to the number average particle diameter is preferably 1.2 or less. Further, the toner preferably contains toner particles having the volume average particle diameter of 2 μm or smaller, in an amount of 1% by number to 10% by number.

<Calculation Methods and Analysis Methods of Various Properties of Toner and Constituent Component of Toner>

The Tg, acid value, hydroxyl value, molecular weight, and melting point of the polyester resin and the release agent may be each measured. Alternatively, each component may be separated from an actual toner by gel permeation chromatography (GPC) or the like, and separated each component may be subjected to the analysis methods described later, to thereby calculate SP value, Tg, molecular weight, melting point, and mass ratio of a constituent component.

Separation of each component by GPC can be performed, for example, by the following method.

In GPC using THF (tetrahydrofuran) as a mobile phase, an eluate is subjected to fractionation by a fraction collector, a fraction corresponding to a part of a desired molecular weight is collected from a total area of an elution curve.

The collected eluates are concentrated and dried by an evaporator or the like, and a resulting solid content is dissolved in a deuterated solvent, such as deuterated chloroform, and deuterated THF, followed by measurement of $^1$H-NMR. From an integral ratio of each element, a ratio of a constituent monomer of the resin in the elution composition is calculated.

As another method, after concentrating the eluate, hydrolysis is performed with sodium hydroxide or the like, and a ratio of a constituent monomer is calculated by subjecting the decomposed product to a qualitative and quantitative analysis by high performance liquid chromatography (HPLC).

Note that, in the case where the method for producing a toner produces toner base particles by generating the non-crystalline polyester resin through a chain-elongation reaction and/or crosslink reaction of the non-linear chain reactive precursor and the curing agent, the non-crystalline polyester resin may be separated from an actual toner by GPC or the like, to thereby determine Tg thereof. Alternatively, a polyester resin is separately generated through a chain-elongation reaction and/or crosslink reaction of the non-linear chain reactive precursor and the curing agent, and Tg may be measured on the synthesized non-crystalline polyester resin.

<<Separation Method of Toner Constituent Components>>

An example of a separation method of each component during analysis of the toner will be specifically described hereinafter.

First, 1 g of a toner is added to 100 mL THF, and the resulting mixture is stirred for 30 minutes at 25° C., to thereby a solution in which soluble components are dissolved.

The solution is then filtered through a membrane filter having an opening of 0.2 μm, to thereby obtain the THF soluble components in the toner.

Next, the THF soluble components are dissolved in THF, to thereby prepare a sample for measurement of GPC, and the prepared sample is supplied to GPC used for molecular weight measurement of each resin mentioned above.

Meanwhile, a fraction collector is disposed at an eluate outlet of GPC, to fraction the eluate per a certain count. The eluate is obtained per 5% in terms of the area ratio from the elution onset on the elution curve (raise of the curve).

Next, each eluted fraction, as a sample, in an amount of 30 mg is dissolved in 1 mL of deuterated chloroform, and to this solution, 0.05% by volume of tetramethyl silane (TMS) is added as a standard material.

A glass tube for NMR having a diameter of 5 mm is charged with the solution, from which a spectrum is obtained by means of a nuclear magnetic resonance apparatus (JNM-AL 400, manufactured by JEOL Ltd.) by performing multiplication 128 times at temperature of 23° C. to 25° C.

The monomer compositions and the compositional ratios of the non-crystalline polyester resin, the crystalline polyester resin, and the like contained in the toner are determined from peak integral ratios of the obtained spectrum.

For example, an assignment of a peak is performed in the following manner, and a constituent monomer component ratio is determined from each integral ratio.

The assignment of a peak is as follows:

Around 8.25 ppm: derived from a benzene ring of trimellitic acid (for one hydrogen atom)

Around the region of 8.07 ppm to 8.10 ppm: derived from a benzene ring of terephthalic acid (for four hydrogen atoms)

Around the region of 7.1 ppm to 7.25 ppm: derived from a benzene ring of bisphenol A (for four hydrogen atoms)

Around 6.8 ppm: derived from a benzene ring of bisphenol A (for four hydrogen atoms), and derived from a double bond of fumaric acid (for two hydrogen atoms)

Around the region of 5.2 ppm to 5.4 ppm: derived from methine of bisphenol A propylene oxide adduct (for one hydrogen atom)

Around the region of 3.7 ppm to 4.7 ppm: derived from methylene of a bisphenol A propylene oxide adduct (for two hydrogen atoms), and derived from methylene of a bisphenol A ethylene oxide adduct (for four hydrogen atoms)

Around 1.6 ppm: derived from a methyl group of bisphenol A (for six hydrogen atoms).

From these results, for example, the extracted product collected in the fraction in which the non-crystalline polyester resin contains 90% by mass or more can be treated as the non-crystalline polyester resin.

Similarly, the extracted product collected in the fraction in which the crystalline polyester resin contains 90% by mass or more can be treated as the crystalline polyester resin.

<<Measurement Methods of Melting Point and Glass Transition Temperature (Tg)>>

In the present invention, a melting point and a glass transition temperature (Tg) can be measured, for example, by means of a differential scanning calorimeter (DSC) system (Q-200, manufactured by TA Instruments Japan Inc.).

Specifically, the melting point and the glass transition temperature of a samples are measured in the following manners.

Specifically, first, an aluminum sample container charged with about 5.0 mg of a sample is placed on a holder unit, and the holder unit is then set in an electric furnace. Next, the sample is heated (first heating) from −80° C. to 150° C. at the heating rate of 10° C./min in a nitrogen atmosphere. Then, the sample is cooled from 150° C. to −80° C. at the cooling rate of 10° C./min, followed by again heating (second heating) to 150° C. at the heating rate of 10° C./min. DSC curves are respectively measured for the first heating and the second heating by means of a differential scanning calorimeter (Q-200, manufactured by TA Instruments Japan Inc.).

The DSC curve for the first heating is selected from the obtained DSC curve by means of an analysis program stored in the Q-200 system, to thereby determine a glass transition temperature of the sample with the first heating. Similarly, the DSC curve for the second heating is selected, and the glass transition temperature of the sample with the second heating can be determined.

Moreover, the DSC curve for the first heating is selected from the obtained DSC curve by means of the analysis program stored in the Q-200 system, and an endothermic peak top temperature of the sample for the first heating is determined as a melting point of the sample. Similarly, the DSC curve for the second heating is selected, and the endothermic peak top temperature of the sample for the second heating can be determined as a melting point of the sample with the second heating.

In the case where a toner is used as a sample, glass transition temperature for the first heating is represented as Tg1st, and glass transition temperature for the second heating is represented as Tg2nd in the present specification.

Also in the present invention, regarding the Tg and the melting point of the non-crystalline polyester resin, the crystalline polyester resin, and the other constituent components such as the release agent, the endothermic peak top temperature and the Tg in the second heating are defined as the melting point and the Tg of each of the target samples, respectively, unless otherwise specified.

The toner preferably contains a polyester resin.

<Polyester Resin>

The polyester resin is not particularly limited and may be appropriately selected depending on the intended purpose. The polyester resin preferably contains a non-crystalline polyester resin and crystalline polyester resin C.

The non-crystalline polyester resin will be non-limitatively described, And non-crystalline polyester resin A as described hereinafter is preferable. The non-crystalline polyester resin A partially contains a crosslinked structure, and may contains, for example, many hydrocarbon groups-containing parts obtained by the reaction of a non-linear reactive precursor such as a non-linear reactive precursor having a branched structure and a curing agent.

A combination of the non-crystalline polyester resin A and different non-crystalline polyester resin(s) (typically, it is (they are) a non-crystalline polyester resin B, which will be described hereinafter) may be preferably used as a combination of both of the non-crystalline polyester resins. The non-crystalline polyester resin B is preferably soluble in THF.

A combination of the non-crystalline polyester resin A and different non-crystalline polyester resin (s)(typically, it is (they are) a non-crystalline polyester resin B, which will be described hereinafter) may be preferably used as the non-crystalline polyester resin.

The non-crystalline polyester resin B contains a dicarboxylic acid component as a constituent component, where the dicarboxylic acid component contains 50% by mole or more of an aromatic part such as terephthalic acid in the structure, which is thus advantageous for the heat resistant storage stability. The non-crystalline polyester resin B is preferably soluble in THF as described above.

By using the combination of the non-crystalline polyester resin A and B, the non-crystalline polyester resin A has an affinity with both the non-crystalline polyester resin B and the crystalline polyester resin C, and is believed to be responsible for a enhancing compatibility between the non-crystalline polyester resin B and the crystalline polyester resin C. Naturally, there is no technical reason that a non-crystalline polyester resin should be restricted to the non-crystalline polyester resin A and B.

Thus, the polyester resin preferably contains a non-crystalline polyester resin A, a non-crystalline polyester resin B, and crystalline polyester resin C.

The polyester resin (A) is soluble in THF, and may be used so long as it satisfies the condition of the present invention. A resin having rubber elasticity at normal temperature is preferable. Thus, the polyester resin (A) has a crosslinked structure, has a glass transition temperature (Tg) at a low temperature region (20° C. or less), and exhibits viscoelastic behavior including a rubber-like status under environments equal to or higher than room temperature. The non-crystalline polyester resin A is preferably obtained by the reaction of a non-linear, reactive precursor and a curing agent.

[Preparation Method of Storage Modulus G']

The values of the [G'(100) (THF insoluble matter)] and the [G'(40) (THF insoluble matter)] can be adjusted by changing the resin composition (bi- or higher functional polyol and bi- or higher functional acid component).

Specifically, they may be adjusted in the following manner, for example.

The G' can be increased by shortening the ester bond in the resin, and/or having the resin composition contain an aromatic ring. In addition, a resin where bulky (flowability is inhibited during melting) segment conformation and configuration such as a branched structure and a star type structure was introduced, may by used.

The G' can be decreased by using a linear polyester resin, and/or a polyol having an alkyl group in a side chain thereof as a constituent component of the resin.

One conceivable method for improving low temperature fixing ability of a toner is lowering the glass transition temperature or the molecular weight of a non-crystalline polyester resin so that the non-crystalline polyester resin melt with a crystalline polyester resin. However, it can easily be imagined that when simply lowering the glass transition temperature or the molecular weight of the non-crystalline polyester resin to lower its melt viscosity, the resultant toner will be degraded in heat resistant storage stability and hot offset resistance upon fixing.

In the toner of the present invention, the non-crystalline polyester resin A has very low glass transition temperature, and thus, has a property of deforming in the resulting toner at a low temperature. Moreover, the non-crystalline polyester resin A has a property of easily attaching on a recoding medium such as paper at lower temperature due to deforming it with heat and pressurization. A reactive precursor of the non-crystalline polyester resin A is non-linear, and thus has a branched structure in its molecular skeleton, so that the molecular chain thereof becomes a three-dimensional network structure.

As a result, the non-crystalline polyester resin A has such rubber-like properties as to deform at low temperature but not flow, enabling the toner to retain heat resistant storage stability and hot offset resistance. Note that, when the non-crystalline polyester resin A preferably contains a urethane bond or a urea bond having high cohesive energy, it is more excellent in adhesion onto recording media such as paper. Also, as a result of containing a urethane bond or a urea bond in the non-crystalline polyester resin A, the urethane bond or the urea bond behaves as a pseudo-crosslinking point to increase rubber-like properties of the polyester resin. As a result, the obtained toner is more excellent in heat resistant storage stability and hot offset resistance.

By using the non-crystalline polyester resin A, which has a glass transition temperature at an extremely low temperature region, has high melt-viscosity, and is difficult to flow, in combination with the non-crystalline polyester resin B and the crystalline polyester resin C in the toner of the present invention, the resulting toner can keep more excellent heat resistant storage stability and hot offset resistance in cases where the glass transition temperature of the obtained toner is set to be lower than the conventional toner. Moreover, by lowering the glass transition temperature thereof, the resulting toner is excellent in low temperature fixing ability.

The non-crystalline polyester resin A preferably contains a urethane bond, a urea bond, or both, because it is more excellent in adhesion onto recording media such as paper. Also, as a result of containing a urethane bond, a urea bond, or both in the non-crystalline polyester resin A, the urethane bond or the urea bond behaves as a pseudo-crosslinking point to increase rubber-like properties of the non-crystalline polyester resin A. As a result, the obtained toner is more excellent in heat resistant storage stability and hot offset resistance.

The non-crystalline polyester resin A contains a dicarboxylic acid component as a constituent component, where the dicarboxylic acid component preferably contains 60% by mole or more of an aliphatic dicarboxylic acid.

Examples of the aliphatic dicarboxylic acid include aliphatic dicarboxylic acids (C4-C12). Examples of the aliphatic dicarboxylic acids (C4-C12) include succinic acid, glutaric acid, adipic acid, pimelic acid, suberic acid, azelaic acid, sebacic acid, and decanedioic acid.

—Non-Linear, Reactive Precursor—

The non-linear, reactive precursor is not particularly limited and may be appropriately selected depending on the intended purpose so long as it is a polyester resin containing a group reactive with the curing agent (hereinafter may be referred to as "prepolymer"). Examples of the group reactive with the curing agent in the prepolymer include a group reactive with an active hydrogen group. Examples thereof include an isocyanate group, an epoxy group, a carboxylic acid group, and an acid chloride group. Among them, the isocyanate group is preferable because it is possible to induce a urethane bond or a urea bond to the non-crystalline polyester resin.

The prepolymer is a non-linear prepolymer. The nonlinear prepolymer means a prepolymer having a branched structure provided with any of trihydric or more alcohol or trivalent or higher carboxylic acid.

As the prepolymer, an isocyanate group-containing polyester resin is preferable.

—Isocyanate Group-Containing Polyester Resin—

The isocyanate group-containing polyester resin is not particularly limited and may be appropriately selected depending on the intended purpose. Examples thereof include a reaction product between an active hydrogen group-containing polyester resin and a polyisocyanate. The active hydrogen group-containing polyester resin can be obtained by polycondensation of, for example, diol, dicarboxylic acid and at least one of trihydric or more alcohol and trivalent or more carboxylic acid. The trihydric or more alcohol and the trivalent or more carboxylic acid give a branch structure to the isocyanate group-containing polyester.

—Diol—

The diol component is not particularly limited and may be appropriately selected depending on the intended purpose. Examples thereof include aliphatic diols such as ethylene glycol, 1,2-propylene glycol, 1,3-propylene glycol, 1,4-butanediol, 3-methyl-1,5-pentanediol, 1,6-hexanediol, 1,8-octanediol, 1,10-decanediol, and 1,12-dodecanediol; diols containing an oxyalkylene group such as diethylene glycol, triethylene glycol, dipropylene glycol, polyethylene glycol, polypropylene glycol and polytetramethylene glycol; alicyclic diols such as 1,4-cyclohexanedimethanol and hydrogenated bisphenol A; adducts of alicyclic diols with alkylene oxides such as ethylene oxide, propylene oxide, and butylene oxide; bisphenols such as bisphenol A, bisphenol F and bisphenol S; and adducts of bisphenols with alkylene oxides such as ethylene oxide, propylene oxide, and butylene oxide. Among them, aliphatic diols having 4 to 12 carbon atoms are preferred.

These diols may be used alone or in combination of two or more thereof.

—Dicarboxylic Acid—

The dicarboxylic acid component is not particularly limited and may be appropriately selected depending on the intended purpose. Examples thereof include aliphatic dicarboxylic acids and aromatic dicarboxylic acids. Besides, anhydrides thereof, lower (C1-C3) alkyl-esterified compounds thereof, or halides thereof may also be used.

The aliphatic dicarboxylic acid is not particularly limited and may be appropriately selected depending on the intended purpose. Examples thereof include succinic acid, adipic acid, sebacic acid, decanedioic acid, maleic acid, and fumaric acid.

The aromatic dicarboxylic acid is not particularly limited and may be appropriately selected depending on the intended purpose. Examples thereof include an aromatic dicarboxylic acid having 8 to 20 carbon atoms. Examples of the aromatic dicarboxylic acid having 8 to 20 carbon atoms are not particularly limited and may be appropriately selected depending on the intended purpose. Examples thereof include phthalic acid, isophthalic acid, terephthalic acid, and naphthalene dicarboxylic acid.

Among them, an aromatic dicarboxylic acids having 4 to 12 carbon atoms are preferable. These dicarboxylic acids may be used alone or in combination of two or more thereof.

—Trihydric or Higher Alcohol—

The trihydric or higher alcohol is not particularly limited and may be appropriately selected depending on the intended purpose. Examples thereof include trihydric or higher aliphatic alcohols, trivalent or more polyphenols, and adducts of alkylene oxide with trivalent or more polyphenols.

Examples of the trihydric or higher aliphatic alcohol include glycerin, trimethylolethane, trimethylolpropane, pentaerythritol, and sorbitol.

Examples of trivalent or more polyphenols include trisphenol PA, phenol novolak, cresol novolak.

Examples of the adducts of alkylene oxide with trivalent or more polyphenols include adducts of trivalent or more polyphenols with alkylene oxides such as ethylene oxide, propylene oxide, and butylene oxide.

The non-crystalline polyester resin A preferably contains the trihydric or higher aliphatic alcohol as a constituent component.

As the non-crystalline polyester resin A contains the trihydric or higher aliphatic alcohol as a constituent component, it makes the polyester resin have a branched structure in its molecular skeleton, so that the molecular chain thereof becomes a three-dimensional network structure. As a result, the polyester resin has such rubber-like properties as to deform it at low temperature but not flow, enabling the toner to retain heat resistant storage stability and hot offset resistance.

The non-crystalline polyester resin A can be formed, by using, for example, a trivalent or higher carboxylic acid or an epoxy as a crosslinked component. In this case, however, a fixed image obtained by fixing the resultant with heat may not show sufficient glossiness since many trivalent or higher carboxylic acids are aromatic compounds or a density of ester bonds of the crosslink components becomes higher. Use of a crosslinking agent such as an epoxy needs crosslinking reaction after polymerization for the polyester, which makes it difficult to control the distance between crosslinked points, potentially leading to failure to obtain intended viscoelasticity and/or degradation in image density or glossiness due to unevenness in the fixed image. The reason why the unevenness in the fixed image arises is that the epoxy tends to react with an oligomer formed during the production of the polyester to form portions having a high crosslinked density.

—Trivalent or Higher Carboxylic Acid—

The trivalent or higher carboxylic acid is not particularly limited and may be appropriately selected depending on the intended purpose. Examples thereof include trivalent or more aromatic dicarboxylic acids. Besides, anhydrides thereof, lower (C1-C3) alkyl-esterified compounds thereof, or halides thereof may also be used.

As the trivalent or more aromatic dicarboxylic acids, trivalent or more aromatic dicarboxylic acids having 9 to 20 carbon atoms are preferable. Examples of the trivalent or more aromatic dicarboxylic acids having 9 to 20 carbon atoms are preferable include trimellitic acid and pyromellitic acid.

—Polyisocyanate—

The polyisocyanate is not particularly limited and may be appropriately selected depending on the intended purpose. Examples thereof include diisocyanate, and trivalent or more isocyanate.

Examples of the diisocyanate include: aliphatic diisocyanate; alicyclic diisocyanate; aromatic diisocyanate; aromatic aliphatic diisocyanate; isocyanurate; and a block product thereof where the foregoing compounds are blocked with a phenol derivative, oxime, or caprolactam.

The aliphatic diisocyanate is not particularly limited and may be appropriately selected depending on the intended purpose. Examples thereof include tetramethylene diisocyanate, hexamethylene diisocyanate, 2,6-diisocyanato methyl caproate, octamethylene diisocyanate, decamethylene diisocyanate, dodecamethylene diisocyanate, tetradecamethylene diisocyanate, trimethylhexane diisocyanate, and tetramethylhexane diisocyanate.

The alicyclic diisocyanate is not particularly limited and may be appropriately selected depending on the intended purpose. Examples thereof include isophorone diisocyanate, and cyclohexylmethane diisocyanate.

The aromatic diisocyanate is not particularly limited and may be appropriately selected depending on the intended purpose. Examples thereof include tolylene diisocyanate, diisocyanato diphenyl methane, 1,5-nephthylene diisocyanate, 4,4'-diisocyanato diphenyl, 4,4'-diisocyanato-3,3'-dimethyldiphenyl, 4,4'-diisocyanato-3-methyldiphenyl methane, and 4,4'-diisocyanato-diphenyl ether.

The aromatic aliphatic diisocyanate is not particularly limited and may be appropriately selected depending on the intended purpose. Examples thereof include $\alpha,\alpha,\alpha',\alpha'$-tetramethylxylene diisocyanate.

The isocyanurate is not particularly limited and may be appropriately selected depending on the intended purpose. Examples thereof include tris(isocyanatoalkyl)isocyanurate, and tris(isocyanatocycloalkyl)isocyanurate.

These polyisocyanates may be used alone or in combination of two or more thereof.

—Curing Agent—

The curing agent is not particularly limited and may be appropriately selected depending on the intended purpose so long as it reacts with the non-linear, reactive precursor, and produces the non-crystalline polyester resin A. Examples thereof include an active hydrogen group-containing compound.

—Active Hydrogen Group-Containing Compound—

An active hydrogen group in the active hydrogen group-containing compound is not particularly limited and may be appropriately selected depending on the intended purpose. Examples thereof include a hydroxyl group (e.g., an alcoholic hydroxyl group, and a phenolic hydroxyl group), an amino group, a carboxyl group, and a mercapto group. These may be used alone or in combination of two or more thereof.

The active hydrogen group-containing compound is not particularly limited and may be appropriately selected depending on the intended purpose, but it is preferably selected from amines, as the amines can form a urea bond.

The amines are not particularly limited and may be appropriately selected depending on the intended purpose. Examples thereof include diamine, trivalent or higher amine, amino alcohol, amino mercaptan, amino acid, and compounds in which the amino groups of the foregoing compounds are blocked. These may be used alone or in combination of two or more thereof.

Among them, diamine, and a mixture of diamine and a small amount of trivalent or higher amine are preferable.

The diamine is not particularly limited and may be appropriately selected depending on the intended purpose. Examples thereof include aromatic diamine, alicyclic diamine, and aliphatic diamine. The aromatic diamine is not particularly limited and may be appropriately selected depending on the intended purpose. Examples thereof include phenylenediamine, diethyl toluene diamine, and 4,4'-diaminodiphenylmethane. The alicyclic diamine is not particularly limited and may be appropriately selected depending on the intended purpose. Examples thereof include 4,4'-diamino-3,3'-dimethyldicyclohexyl methane, diaminocyclohexane, and isophoronediamine. The aliphatic diamine is not particularly limited and may be appropriately selected depending on the intended purpose. Examples thereof include ethylene diamine, tetramethylene diamine, and hexamethylenediamine.

The trivalent or higher amine is not particularly limited and may be appropriately selected depending on the intended purpose. Examples thereof include diethylenetriamine, and triethylene tetramine. The amino alcohol is not particularly limited and may be appropriately selected depending on the intended purpose. Examples thereof include ethanol amine, and hydroxyethyl aniline. The aminomercaptan is not particularly limited and may be appropriately selected depending on the intended purpose. Examples thereof include aminoethyl mercaptan, and aminopropyl mercaptan. The amino acid is not particularly limited and may be appropriately selected depending on the intended purpose. Examples thereof include aminopropionic acid, and aminocaproic acid. The compound where the amino group is blocked is not particularly limited and may be appropriately selected depending on the intended purpose. Examples thereof include a ketimine compound where the amino group is blocked with ketone such as acetone, methyl ethyl ketone, methyl isobutyl ketone, and an oxazoline compound.

The non-crystalline polyester resin A preferably contains a diol component in a constituent component in order to lower a Tg thereof to thereby easily provide it with property of deforming at a low temperature. The diol component preferably contains an aliphatic diol having 4 to 12 carbon atoms in an amount of 50% by mass or more.

Moreover, the non-crystalline polyester resin A preferably contains an aliphatic diol having 4 to 12 carbon atoms in an amount of 50% by mass or more in a total alcohol component, in order to lower a Tg thereof to thereby easily provide it with property of deforming at a low temperature.

The non-crystalline polyester resin A preferably contains dicarboxylic acid in a constituent component in order to lower a Tg thereof to thereby easily provide it with property of deforming at a low temperature. The dicarboxylic acid component preferably contains an aliphatic dicarboxylic acid having 4 to 12 carbon atoms in an amount of 50% by mass or more.

A glass transition temperature of the non-crystalline polyester resin A is preferably −60° C. to 0° C., more preferably −40° C. to −20° C. When the glass transition temperature thereof is less than −60° C., heat resistant storage stability of the toner, filming resistance to a photoconductor, and blocking within a developing unit may be impaired. When the glass transition temperature thereof is more than 0° C., the deformation of the toner with heat and pressurization during fixing may be insufficient, and low temperature fixing ability may be insufficient.

A weight average molecular weight of the non-crystalline polyester resin A is not particularly limited and may be appropriately selected depending on the intended purpose. As measured by GPC (gel permeation chromatography), the weight average molecular weight thereof is preferably 20,000 to 1,000,000, more preferably 50,000 to 300,000, still more preferably 100,000 to 200,000. When the weight average molecular weight thereof is less than 20,000, the resulting toner is likely to flow at a low temperature which may deteriorate heat resistant storage stability. In addition, a viscosity of the resulting toner may lower during melting, which may impair high temperature offset property.

A molecular structure of the non-crystalline polyester resin A can be confirmed by solution-state or solid-state NMR, X-ray diffraction, GC/MS, LC/MS, or IR spectroscopy. Simple methods thereof include a method for detecting, as a non-crystalline polyester resin, one that does not have absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

An amount of the non-crystalline polyester resin A is not particularly limited and may be appropriately selected depending on the intended purpose, but it is preferably 5 parts by mass to 25 parts by mass, more preferably 10 parts by mass to 20 parts by mass, relative to 100 parts by mass of the toner. When the amount thereof is smaller than 5 parts by mass, low temperature fixing ability, and hot offset resistance of a resulting toner may be impaired. When the amount thereof is greater than 25 parts by mass, heat resistant storage stability of the toner may be impaired, and glossiness of an image obtained after fixing may be reduced. When the amount thereof is within the aforementioned more preferable range, it is advantageous because all of the low temperature fixing ability, hot offset resistance, and heat resistant storage stability excel.

<<Non-Crystalline Polyester Resin B>>

A glass transition temperature of the non-crystalline polyester resin B is preferably higher than a glass transition temperature of the non-crystalline polyester resin A, and it is preferably 40° C. to 80° C.

As the non-crystalline polyester resin B, a linear polyester resin is preferable.

As the non-crystalline polyester resin B, an unmodified polyester resin is preferable. The unmodified polyester resin is a polyester resin obtained by using polyhydric alcohol, and multivalent carboxylic acids such as multivalent carboxylic acid, multivalent carboxylic acid anhydride, multivalent carboxylic acid esther, or derivatives thereof, and is a polyester resin which is not modified by isocyanate compounds and the like. The non-crystalline polyester resin B preferably contains neither a urethane bond nor a urea bond.

The non-crystalline polyester resin B contains a dicarboxylic acid component as a constituent component, where the dicarboxylic acid component preferably contains 50% by mole or more of terephthalic acid, which is advantageous for heat resistant storage stability.

Examples of the polyhydric alcohol include diol.

The diol include alkylene (having 2 to 3 carbon atoms) oxide (average addition molar number is 1 to 10) adduct of bisphenol A such as polyoxypropylene(2.2)-2,2-bis(4-hydroxyphenyl)propane, and polyoxyethylene(2.2)-2,2-bis(4-hydroxyphenyl)propane; ethylenegrycol, propylenegrycol; and hydrogenated bisphenol A, and alkylene (having 2 to 3 carbon atoms) oxide (average addition molar number is 1 to 10) adduct of hydrogenated bisphenol A. They may be used alone or in combination of two or more.

Examples of the multivalent carboxylic acid include dicarboxylic acid. Examples of the dicarboxylic acid include: adipic acid, phthalic acid, isophthalic acid, terephthalic acid, fumaric acid, maleic acid; and succinic acid substituted by an alkyl group having 1 to 20 carbon atoms or an alkenyl group having 2 to 20 carbon atoms such as dodecenylsuccinic acid and octylsuccinic acid. These may be used alone or in combination of two or more.

The non-crystalline polyester resin B may contain at least one of a trivalent or higher carboxylic acid and a trivalent or higher alcohol at the end of the resin chain in order to adjust an acid value and a hydroxyl value.

Examples of the trivalent or higher carboxylic acid include trimellitic acid, pyromellitic acid, and acid anhydride thereof.

Examples of the trihydric or more alcohol include glycerin, pentaerythritol, and trymethylol propane.

A molecular weight of the non-crystalline polyester resin B is not particularly limited and may be appropriately selected depending on the intended purpose. However, when the molecular weight thereof is too low, heat resistant storage stability of the toner and durability against stress such as stirring in the developing unit may be deteriorated. When the molecular weight thereof is too high, viscoelasticity of the toner during melting may be high, which may deteriorate low temperature fixing ability. Thus, a weight average molecular weight (Mw) is preferably 3,000 to 10,000 as measured by GPC (gel permeation chromatography). A number average molecular weight (Mn) is preferably 1,000 to 4,000. Moreover, Mw/Mn is preferably 1.0 to 4.0. The weight average molecular weight (Mw) is more preferably 4,000 to 7,000. The number average molecular weight (Mn) is more preferably 1,500 to 3,000. The Mw/Mn is more preferably 1.0 to 3.5.

The acid value of the non-crystalline polyester resin B is not particularly limited and may be appropriately selected depending on the intended purpose. The acid value thereof is preferably 1 mg to 50 mg KOH/g, more preferably 5 mg to 30 mg KOH/g. When the acid value is 1 mg KOH/g or more, a resulting toner is likely to be negatively charged. In addition, a resulting toner has good affinity between the paper and the toner when fixed on the paper, which may improve low temperature fixing ability. Meanwhile, when the acid value is more than 50 mg KOH/g, a resulting toner may deteriorate charging stability, especially charging stability against environmental change.

The hydroxyl value of the non-crystalline polyester resin B is not particularly limited and may be appropriately selected depending on the intended purpose. The hydroxyl value thereof is preferably 5 mg KOH/g or more.

A glass transition temperature (Tg) of the non-crystalline polyester resin B is preferably 40° C. to 80° C., more preferably 50° C. to 70° C. When the Tg thereof is less than 40° C., a resulting toner may have low heat resistant storage stability, low durability against stress such as stirring in the developing unit, and filming resistance of the toner may be deteriorated. Meanwhile, when the glass transition temperature is more than 80° C., the deformation of the toner with heat and pressurization during fixing may be insufficient, which leads to insufficient low temperature fixing ability.

A molecular structure of the non-crystalline polyester resin B can be confirmed by solution-state or solid-state NMR, X-ray diffraction, GC/MS, LC/MS, or IR spectroscopy. Simple methods thereof include a method for detecting, as a non-crystalline polyester resin, one that does not have absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

An amount of the non-crystalline polyester resin B is not particularly limited and may be appropriately selected depending on the intended purpose, but it is preferably 50 parts by mass to 90 parts by mass, more preferably 60 parts by mass to 80 parts by mass, relative to 100 parts by mass of the toner. When the amount thereof is less than 50 parts by mass, dispersiveness of the pigment and the release agent in the toner may be deteriorated, and fogging and artifact of an image may be caused. Meanwhile, when the amount thereof is more than 90 parts by mass, the amount of the crystalline polyester resin C and the non-crystalline polyester resin A are low, which may deteriorate low temperature fixing ability. When the amount thereof is within more preferable range than the aforementioned range, it is advantageous because a resulting toner is excellent in terms of both high image quality and low temperature fixing ability.

<<Crystalline Polyester Resin C>>

The crystalline polyester resin C has high crystallinity and relatively lower enthalpy of fusion, and thus, exhibits heat melting characteristics that a drastic drop in a viscosity takes place at a temperature around fixing onset temperature. By using the crystalline polyester resin C having heat melting characteristics together with the noncrystalline polyester resin B, the heat resistant storage stability of the toner is excellent up to the melt onset temperature owing to crystallinity, and the toner drastically decreases its viscosity (sharp melt properties) at the melt onset temperature because of melting of the crystalline polyester resin C. Along with the drastic decrease in viscosity, the crystalline polyester resin C is melt together with the non-crystalline polyester resin B, to drastically decrease their viscosity to thereby be fixed. Accordingly, a toner having excellent heat resistant storage stability and low temperature fixing ability can be obtained. Moreover, the toner has excellent results in terms of a releasing width (a difference between the minimum fixing temperature and hot offset occurring temperature).

The crystalline polyester resin C, as described above, can be obtained by using a polyhydric alcohol and a multivalent carboxylic acid or a derivative thereof such as a multivalent carboxylic acid anhydride and a multivalent carboxylic acid ester.

Note that, in the present invention, the crystalline polyester resin C is one obtained from a polyhydric alcohol and a multivalent carboxylic acid or a derivative thereof such as a multivalent carboxylic acid anhydride and a multivalent carboxylic acid ester, as described above, and a resin obtained by modifying a polyester resin, for example, the aforementioned prepolymer and a resin obtained through cross-link and/or chain elongation reaction of the prepolymer do not belong to the crystalline polyester resin C.

—Polyhydric Alcohol—

The polyhydric alcohol is not particularly limited and may be appropriately selected depending on the intended purpose. Examples thereof include diol, and trihydric or higher alcohol. Examples of the diol include saturated aliphatic diol. Examples of the saturated aliphatic diol include straight chain saturated aliphatic diol, and branched-chain saturated aliphatic diol. Among them, straight chain saturated aliphatic diol is preferable, and C2-C12 straight chain saturated aliphatic diol is more preferable. When the saturated aliphatic diol has a branched-chain structure, crystallinity of the crystalline polyester resin C may be low, and thus may lower the melting point. When the number of carbon atoms in the saturated aliphatic diol is greater than 12, it may be difficult to yield a material in practice. The number of carbon atoms is therefore preferably 12 or less.

Examples of the saturated aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among them, ethylene glycol, 1,4-butanediol, 1,6-hexanediol, 1,8-octanediol, 1,10-decanediol, and 1,12-dodecanediol are preferable, as they give high crystallinity to a resulting crystalline polyester resin C, and give excellent sharp melt properties.

Examples of the trihydric or higher alcohol include glycerin, trimethylol ethane, trimethylolpropane, and pentaerythritol.

These may be used alone or in combination of two or more thereof.

—Multivalent Carboxylic Acid—

The multivalent carboxylic acid is not particularly limited and may be appropriately selected depending on the intended purpose. Examples thereof include divalent carboxylic acid, and trivalent or higher carboxylic acid.

Examples of the divalent carboxylic acid include: saturated aliphatic dicarboxylic acid, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acid of dibasic acid, such as phthalic acid, isophthalic acid, terephthalic acid, naphthalene-2,6-dicarboxylic acid, malonic acid, and mesaconic acid; and anhydrides of the foregoing compounds, and lower (C1-C3) alkyl ester of the foregoing compounds.

Examples of the trivalent or higher carboxylic acid include 1,2,4-benzenetricarboxylic acid, 1,2,5-benzenetricarboxylic acid, 1,2,4-naphthalene tricarboxylic acid, anhydrides thereof, and lower (C1-C3) alkyl esters thereof.

Moreover, the multivalent carboxylic acid may contain, other than the saturated aliphatic dicarboxylic acid or aromatic dicarboxylic acid, dicarboxylic acid containing a sulfonic acid group. Further, the multivalent carboxylic acid may contain, other than the saturated aliphatic dicarboxylic acid or aromatic dicarboxylic acid, dicarboxylic acid having a double bond.

These may be used alone or in combination of two or more thereof.

The crystalline polyester resin C is preferably composed of a straight chain saturated aliphatic dicarboxylic acid having 4 to 12 carbon atoms and a straight chain saturated aliphatic diol having 2 to 12 carbon atoms. Specifically, the crystalline polyester resin C preferably contains a constituent unit derived from a saturated aliphatic dicarboxylic acid having 4 to 12 carbon atoms, and a constituent unit derived from a saturated aliphatic diol having 2 to 12 carbon atoms. As a result of this, crystallinity increases, and sharp melt properties improve, and therefore it is preferable as excellent low temperature fixing ability of the toner is exhibited.

A melting point of the crystalline polyester resin C is not particularly limited and may be appropriately selected depending on the intended purpose, but it is preferably 60° C. to 80° C. When the melting point thereof is lower than 60° C., the crystalline polyester resin C tends to be melted at low temperature, which may impair heat resistant storage stability of the toner. When the melting point thereof is higher than 80° C., melting of the crystalline polyester resin C with heat applied during fixing may be insufficient, which may impair low temperature fixing ability of the toner.

A molecular weight of the crystalline polyester resin C is not particularly limited and may be appropriately selected depending on the intended purpose. Since those having a sharp molecular weight distribution and low molecular weight have excellent low temperature fixing ability, and heat resistant storage stability of a resulting toner lowers as an amount of a low molecular weight component, an o-dichlorobenzene soluble component of the crystalline polyester resin C preferably has the weight average molecular weight (Mw) of 3,000 to 30,000, number average molecular weight (Mn) of 1,000 to 10,000, and Mw/Mn of 1.0 to 10, as measured by GPC. Further, it is more preferred that the weight average molecular weight (Mw) thereof be 5,000 to 15,000, the number average molecular weight (Mn) thereof be 2,000 to 10,000, and the Mw/Mn be 1.0 to 5.0.

An acid value of the crystalline polyester resin C is not particularly limited and may be appropriately selected depending on the intended purpose, but it is preferably 5 mg KOH/g or higher, more preferably 10 mg KOH/g or higher for achieving the desired low temperature fixing ability in view of affinity between paper and the resin. Meanwhile, the acid value thereof is preferably 45 mg KOH/g or lower for the purpose of improving hot offset resistance.

A hydroxyl value of the crystalline polyester resin C is not particularly limited and may be appropriately selected depending on the intended purpose, but it is preferably 0 mg KOH/g to 50 mg KOH/g, more preferably 5 mg KOH/g to 50 mg KOH/g, for achieving the desired low temperature fixing ability and excellent charging properties.

A molecular structure of the crystalline polyester resin C can be confirmed by solution-state or solid-state NMR, X-ray diffraction, GC/MS, LC/MS, or IR spectroscopy. Simple methods thereof include a method for detecting, as the crystalline polyester resin C, one that has absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

An amount of the crystalline polyester resin C is not particularly limited and may be appropriately selected depending on the intended purpose, but it is preferably 3 parts by mass to 20 parts by mass, more preferably 5 parts by mass to 15 parts by mass, relative to 100 parts by mass of the toner. When the amount thereof is smaller than 3 parts by mass, the crystalline polyester resin C does not give sufficient sharp melt properties, which may lead to insufficient low temperature fixing ability of a resulting toner. When the amount thereof is greater than 20 parts by mass, a resulting toner may have low heat resistant storage stability, and tends to cause fogging of an image. When the amount thereof is within the aforementioned more preferable range, it is advantageous because a resulting toner is excellent in terms of both high image quality and low temperature fixing ability.

—Colorant Dispersing Resin—

Toner base particles preferably contain a colorant dispersing resin. The colorant dispersing resin is used in order to disperse the colorant in a binder resin of the toner.

When a toner containing a non-crystalline polyester resin A, which is THF insoluble matter, and a crystalline resin is produced in an aqueous medium, a pigment (i.e., colorant) is tend to be localized on the surface. When a resin satisfying the specific conditions as shown below, is used, the pigment is environed with the dispersion resin in the toner. Thus, the localization on the surface is improved by the pigment, and thus, the pigment may inhibit to impede heat conduction.

A solution containing a colorant dispersing resin dispersed or dissolved in ethyl acetate preferably exhibits the following properties.

1) The solution having a concentration of 20% by mass satisfies the following expressions:

T(60)%−T(480)%≥30%, and T(480)% is 50% or less, where the T(60)% is a transmittance of the solution at an optical path length of 1 cm after the solution has been left for 60 minutes, and the T(480)% is a transmittance of the solution at an optical path length of 1 cm after the solution has been left for 480 minutes.

2) The T(60)% is 30% or more.

The colorant dispersing resin preferably causes a physical gel by emulsifying or dispersing a toner composition liquid in an aqueous medium, then by dissolving the toner composition liquid and by binding molecules together, where the toner composition liquid is prepared by dissolving or dispersing the colorant dispersing resin with a binder resin, a colorant, and a release agent in an organic solvent.

The physical gel caused by the colorant dispersing resin in the solution captures the colorant mechanically dispersed in the solution therein, and thus make it possible to inhibit the colorant from reaggregating in the toner composition solution, and to inhibit the colorant from bleeding out from the binder resin in the toner particles. As a confirmation method where the colorant dispersing resin can form the physical gel in the solution, it can be confirmed that a solution containing the colorant dispersing resin dissolved in ethyl acetate so as to have a solid content of 20% by mass satisfies the following expressions: T(60)%−T(480)%≥30%, the T(480)% is 50% or less, and the T(60)% is 30% or more. When the T(60)%−T(480)% is less than 30%, or T(480)% is more than 50%, solubility of the colorant dispersing resin may be high, which leads to insufficient formation of the physical gel, and thus, may not obtain an effect where pigment primary particles automatically dispersed is retained without reaggregation during producing the toner composition liquid. When the T(60)% is less than 30%, solubility of the colorant dispersing resin may be low, the physical gel may be extremely formed, and thus, may leads to aggregation of the pigment to thereby lower a degree of pigmentation.

Preferably, the ratio of the colorant dispersing resin is 50% by mass to 95% by mass in a master batch, and is 6% by mass to 60% by mass in the toner. When the ratio thereof is less than 50% by mass in a master batch, and is less than 6% by mass in the toner, a pigment which does not mix with the colorant dispersing resin may occur, and thus an effect of dispersibility of the pigment may not be obtained. When the ratio thereof is more than 95% by mass in the master batch, and is more than 60% by mass in the toner, an amount of the colorant dispersing resin increasingly occupies in a total amount of the toner, which may affect heat property of the resulting toner, which may possibly lead to defects during fixing.

<Method for Measuring Transmittance of Colorant Dispersing Resin Solution>

The colorant dispersing resin (20 g) is added to 80 g of ethyl acetate adjusted to 40° C. in advance, and is dissolved in a shaker. Disappearance of the particles of the resin has been visually confirmed, and then, the resulting mixture is put in a thermostat bath adjusted to 40° C., and is left to stand still in position. Then, a sample of the colorant dispersing resin solution is charged into a glass cell having an optical path length of 1 cm, and immediately after that, the glass cell is set in a spectrophotometer (V-660, product of JASCO Corporation) to thereby measure transmittance under a light of 500 nm.

<Method for Confirming a Localized State of Colorant>

Specifically, an ultra-thin section of the toner is prepared, and observed under a TEM (transmission electron microscope) at a magnitude of ×100,000 to obtain an image. The obtained image is binarized through image processing, and the area occupied by the colorant is defined as S1, which is an area of the colorant within 1,000 nm from the uppermost surface, and the area occupied by the colorant is defined as S2, which is an area of the colorant over 1,000 nm from the uppermost surface. Thus, a localized status of the colorant can be determined.

One requirement of the present invention is S1/(S1+S2) ≤0.5.

This value can be obtained by examining images of randomly selected 10 toner base particles having the maximum diameter of the volume average particle diameter±10%, followed by averaging.

—Colorant—

The colorant is appropriately selected depending on the intended purpose without any limitation, and examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazine lake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmine 6B, pigment scarlet 3B, Bordeaux 5B, toluidine Maroon, permanent Bordeaux F2K, Hello Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone. Naphthol red is preferable.

An amount of the colorant is not particularly limited and may be appropriately selected depending on the intended purpose, but it is preferably 1 part by mass to 15 parts by mass, more preferably 3 parts by mass to 10 parts by mass, relative to 100 parts by mass of the toner.

An amine value of the colorant is not particularly limited and may be appropriately selected depending on the intended purpose. It is preferably 2 mg KOH/mg or less, more preferably 1 mg KOH/mg or less.

When the amine value of the colorant is more than 2 mg KOH/mg, adsorption of a colorant and a resin may lower, and thus, pigment dispersibility may not adequately be obtained.

<Measurement of Amine Value of Colorant>

An amine value was measured based on the measurement method (Toshikatsu Kobayashi, Koichi Tsutsui, Shouji Ikeda: *Shikizai* (Color material), 61,692 (1988)). Into an Erlenmeyer flask, 2 g of a pigment and 30 ml of 0.01M perchloric acid (PCA)-MIBK solution as an acid were charged, followed by tightly stoppering. Then, the mixture was subjected to ultrasonic dispersion for 1 hour in an ultrasonic cleaner (product of BRONSON, BRONSONIC321), in which a water-bath temperature was controlled to 20° C. The obtained dispersion liquid was subjected to centrifugation to thereby eliminate the pigment. With a liquid mixture (ratio of MIBK to methanol was 4:1), 10 mL of the obtained supernatant liquid was diluted, followed by titrating with 0.01M potassium methoxide. An amount of amine per unit weight of the pigment was calculated by using an amount of perchloric acid consumed by the base present on the surface of the pigment, to thereby determine as an amine value (mg KOH/mg). Note that, an automatic potentiometric titrator (product of Kyoto Electronics Manufacturing Co., Ltd., AT-500N) was used to titrate, and #100-C172 (product of Kyoto Electronics Manufacturing Co., Ltd.) was used as an electrode. Potassium methoxide (0.01M) was prepared by 10-fold diluting 0.1M potassium methoxide-benzene methanol solution (product of KISHIDA CHEMICAL Co., Ltd.), which is used for a nonaqueous titration, with a 4:1 liquid mixture of MIBK and methanol. As the other chemicals, special grade chemicals were used.

The colorant may be used as a master batch in which the colorant forms a composite with a resin. Examples of the binder resin kneaded in the production of, or together with the master batch include, other than the aforementioned non-crystalline polyester resin, polymer of styrene or substitution thereof (e.g., polystyrene, poly-p-chlorostyrene, and polyvinyl); styrene copolymer (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-methyl vinyl ketone copolymer, styrene-butadiene copolymer, styrene-isoprene copolymer, styrene-acrylonitrile-indene copolymer, styrene-maleic acid copolymer, and styrene-maleic acid ester copolymer); and others including polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, a terpene resin, an aliphatic or alicyclic hydrocarbon resin, an aromatic petroleum resin, chlorinated paraffin, and paraffin wax. These may be used alone or in combination.

The master batch can be prepared by mixing and kneading the colorant with the resin for the master batch. In the mixing and kneading, an organic solvent may be used for improving the interactions between the colorant and the resin. Moreover, the master batch can be prepared by a flashing method in which an aqueous paste containing a colorant is mixed and kneaded with a resin and an organic solvent, and then the colorant is transferred to the resin to remove the water and the organic solvent. This method is preferably used because a wet cake of the colorant is used as it is, and it is not necessary to dry the wet cake of the colorant to prepare a colorant. In the mixing and kneading of the colorant and the resin, a high-shearing disperser (e.g., a three-roll mill) is preferably used.

<Other Components>

Examples of other components include a release agent, a charge controlling agent, an external additive, a flow improving agent, a cleaning improving agent, and a magnetic material.

—Release Agent—

The release agent is appropriately selected from those known in the art without any limitation.

Examples of wax serving as the release agent include: natural wax, such as vegetable wax (e.g., carnauba wax, cotton wax, Japan wax and rice wax), animal wax (e.g., bees wax and lanolin), mineral wax (e.g., ozokelite and ceresine) and petroleum wax (e.g., paraffin wax, microcrystalline wax and petrolatum).

Examples of the wax other than the above natural wax include synthetic hydrocarbon wax (e.g., Fischer-Tropsch wax and polyethylene wax; and synthetic wax (e.g., ester wax, ketone wax and ether wax).

Further, other examples of the release agent include fatty acid amides such as 12-hydroxystearic acid amide, stearic amide, phthalic anhydride imide and chlorinated hydrocarbons; low-molecular-weight crystalline polymers such as acrylic homopolymers (e.g., poly-n-stearyl methacrylate and poly-n-lauryl methacrylate) and acrylic copolymers (e.g., n-stearyl acrylate-ethyl methacrylate copolymers); and crystalline polymers having a long alkyl group as a side chain.

Among them, hydrocarbon wax, such as paraffin wax, microcrystalline wax, Fischer-Tropsch wax, polyethylene wax, and polypropylene wax, is preferable.

A melting point of the release agent is not particularly limited and may be appropriately selected depending on the intended purpose, but it is preferably 60° C. to 80° C. When the melting point thereof is lower than 60° C., the release agent tends to melt at low temperature, which may impair heat resistant storage stability. When the melting point thereof is higher than 80° C., the release agent is not sufficiently melted to thereby cause fixing offset even in the case where the resin is melted and is in the fixing temperature range, which may cause defects in an image.

An amount of the release agent is appropriately selected depending on the intended purpose without any limitation, but it is preferably 2 parts by mass to 10 parts by mass, more preferably 3 parts by mass to 8 parts by mass, relative to 100 parts by mass of the toner. When the amount thereof is smaller than 2 parts by mass, a resulting toner may have insufficient hot offset resistance, and low temperature fixing ability during fixing. When the amount thereof is greater than 10 parts by mass, a resulting toner may have insufficient heat resistant storage stability, and tends to cause fogging in an image. When the amount thereof is within the aforementioned more preferable range, it is advantageous because image quality and fixing stability can be improved.

—Charge Controlling Agent—

The charge controlling agent is appropriately selected depending on the intended purpose without any limitation, and examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives.

Specific examples thereof include: nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (all manufactured by ORIENT CHEMICAL INDUSTRIES CO., LTD); quaternary ammonium salt molybdenum complex TP-302 and TP-415 (all manufactured by Hodogaya Chemical Co., Ltd.); LRA-901; boron complex LR-147 (manufactured by Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

An amount of the charge controlling agent is not particularly limited and may be appropriately selected depending on the intended purpose, but it is preferably 0.1 parts by mass to 10 parts by mass, more preferably 0.2 parts by mass to 5 parts by mass, relative to 100 parts by mass of the toner. When the amount thereof is greater than 10 parts by mass, the charging ability of the toner becomes excessive, which may reduce the effect of the charge controlling agent, increase electrostatic force to a developing roller, leading to low flowability of the developer, or low image density of the resulting image. These charge controlling agents may be dissolved and dispersed after being melted and kneaded together with the master batch, and/or resin. The charge controlling agents can be, of course, directly added to an organic solvent when dissolution and dispersion is performed. Alternatively, the charge controlling agents may be fixed on surfaces of toner particles after the production of the toner particles.

—External Additive—

As for the external additive, other than oxide particles, a combination of inorganic particles and hydrophobic-treated inorganic particles can be used. The average primary particle diameter of the hydrophobic-treated particles is preferably 1 nm to 100 nm. More preferred are the inorganic particles of 5 nm to 70 nm.

Moreover, it is preferred that the external additive contain at least one type of hydrophobic-treated inorganic particles having the average primary particle diameter of 20 nm or smaller, and at least one type of inorganic particles having the average primary particle diameter of 30 nm or greater. Moreover, the external additive preferably has the BET specific surface area of 20 $m^2/g$ to 500 $m^2/g$.

The external additive is not particularly limited and may be appropriately selected depending on the intended purpose. Examples thereof include silica particles, hydrophobic silica, fatty acid metal salts (e.g., zinc stearate, and aluminum stearate), metal oxide (e.g., titania, alumina, tin oxide, and antimony oxide), and a fluoropolymer.

Examples of the suitable additive include hydrophobic silica, titania, titanium oxide, and alumina particles. Examples of the silica particles include R972, R974, RX200, RY200, R202, R805, and R812 (all manufactured by Nippon Aerosil Co., Ltd.). Examples of the titania particles include P-25 (manufactured by Nippon Aerosil Co., Ltd.); STT-30, STT-65C-S (both manufactured by Titan Kogyo, Ltd.); TAF-140 (manufactured by Fuji Titanium Industry Co., Ltd.); and MT-150 W, MT-500B, MT-600 B, MT-150A (all manufactured by TAYCA CORPORATION).

Examples of the hydrophobic treated titanium oxide particles include; T-805 (manufactured by Nippon Aerosil Co., Ltd.); STT-30A, STT-65S-S (both manufactured by Titan Kogyo, Ltd.); TAF-500T, TAF-1500T (both manufactured by Fuji Titanium Industry Co., Ltd.); MT-100S, MT-100 T (both manufactured by TAYCA CORPORATION); and IT-S (manufactured by ISHIHARA SANGYO KAISHA, LTD.).

The hydrophobic-treated oxide particles, hydrophobic-treated silica particles, hydrophobic-treated titania particles, and hydrophobic-treated alumina particles are obtained, for example, by treating hydrophilic particles with a silane coupling agent, such as methyltrimethoxy silane, methyltriethoxy silane, and octyltrimethoxy silane. Moreover, silicone oil-treated oxide particles, or silicone oil-treated inorganic particles, which have been treated by adding silicone oil optionally with heat, are also suitably used as the external additive.

Examples of the silicone oil include dimethyl silicone oil, methylphenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, methacryl-modified silicone oil, and α-methylstyrene-modified silicone oil.

Examples of the inorganic particles include silica, alumina, titanium oxide, barium titanate, magnesium titanate, calcium titanate, strontium titanate, iron oxide, copper oxide, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Among them, silica and titanium dioxide are preferable.

An amount of the external additive is not particularly limited and may be appropriately selected depending on the intended purpose, but it is preferably 0.1 parts by mass to 5 parts by mass, more preferably 0.3 parts by mass to 3 parts by mass, relative to 100 parts by mass of the toner.

The average particle diameter of primary particles of the inorganic particles is not particularly limited and may be appropriately selected depending on the intended purpose, but it is preferably 100 nm or smaller, more preferably 3 nm to 70 nm. When it is smaller than the aforementioned range, the inorganic particles are embedded in the toner particles, and therefore the function of the inorganic particles may not be effectively exhibited. When the average particle diameter thereof is greater than the aforementioned range, the inorganic particles may unevenly damage a surface of a photoconductor, and hence not preferable.

—Flowability Improving Agent—

The flowability improving agent is not particularly limited and may be appropriately selected depending on the intended purpose so long as it is capable of performing surface treatment of the toner to increase hydrophobicity, and preventing degradations of flow properties and charging properties of the toner even in a high humidity environment. Examples thereof include a silane-coupling agent, a sililation agent, a silane-coupling agent containing a fluoroalkyl group, an organic titanate-based coupling agent, an aluminum-based coupling agent, silicone oil, and modified silicone oil. It is particularly preferred that the silica or titanium oxide be used as hydrophobic silica or hydrophobic titanium oxide treated with the aforementioned flow improving agent.

—Cleanability Improving Agent—

The cleanability improving agent is not particularly limited and may be appropriately selected depending on the intended purpose so long as it can be added to the toner for the purpose of removing the developer remained on a photoconductor or primary transfer member after transferring. Examples thereof include; fatty acid metal salt such as zinc stearate, calcium stearate, and stearic acid; and polymer particles produced by soap-free emulsion polymerization, such as polymethyl methacrylate particles, and polystyrene particles. The polymer particles are preferably those having a relatively narrow particle size distribution, and the polymer particles having the volume average particle diameter of 0.01 μm to 1 μm are preferably used.

—Magnetic Material—

The magnetic material is not particularly limited and may be appropriately selected depending on the intended purpose. Examples thereof include iron powder, magnetite, and ferrite. Among them, a white magnetic material is preferable in terms of a color tone.

<<Measurement Method for Particle Size Distribution>>

The volume average particle diameter (D4), the number average particle diameter (Dn), and the ratio therebetween (D4/Dn) of the toner can be measured using, for example, Coulter Counter TA-II or Coulter Multisizer II (these products are of Coulter, Inc.). In the present invention, Coulter Multisizer II was used. The measurement method is as follows.

First, a surfactant (0.1 mL to 5 mL), preferably a polyoxyethylene alkyl ether (nonionic surfactant), is added as a dispersing agent to an aqueous electrolyte solution (100 mL to 150 mL). Here, the aqueous electrolyte solution is an about 1% by mass aqueous NaCl solution prepared using 1st grade sodium chloride, and ISOTON-II (product of Coulter, Inc.) can be used as the aqueous electrolyte solution. Next, a measurement sample in an amount of 2 mg to 20 mg is added therein. The resultant aqueous electrolyte solution in which the sample has been suspended is dispersed with an ultrasonic wave disperser for about 1 min to about 3 min. The thus-obtained dispersion liquid is analyzed with the above-described apparatus using an aperture of 100 μm to measure the number or volume of the toner particles (or toner). Then, the volume particle size distribution and the number particle size distribution are calculated from the obtained values. From these distributions, the volume average particle diameter (D4) and the number average particle diameter (Dn) of the toner can be obtained.

In this measurement, 13 channels are used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) were subjected to the measurement.

<<Measurement of Molecular Weight>>

The molecular weight of each of the constituent components of the toner can be measured by the following method, for example.

Gel permeation chromatography (GPC) measuring apparatus: GPC-8220 GPC (product of TOSOH CORPORATION)

Column: TSKgel Super HZM-H 15 cm, 3 columns connected (product of TOSOH CORPORATION)

Temperature: 40° C.

Solvent: THF

Flow rate: 0.35 mL/min

Sample: 0.15% by mass sample (100 μL) applied

Pretreatment of sample: The toner is dissolved in tetrahydrofuran (THF) (containing a stabilizer, product of Wako Pure Chemical Industries, Ltd.) in a concentration of 0.15% by mass, and the solution is filtrated with a 0.2-μm filter. The resultant filtrate is used as a sample. This THF sample solution (100 μL) is applied for measurement.

In the measurement of the molecular weight of the sample, the molecular weight distribution of the sample is determined based on the relationship between the logarithmic value and the count number of a calibration curve given by using several monodisperse polystyrene-standard samples. The standard polystyrene samples used for giving the calibration curve are Showdex STANDARD Std. Nos. S-7300, S-210, S-390, S-875, S-1980, S-10.9, S-629, S-3.0 and S-0.580 (these products are of SHOWA DENKO K.K.). The detector used is a refractive index (RI) detector.

<Production Method for the Toner>

A production method for the toner is not particularly limited and may be appropriately selected depending on the intended purpose. Preferably, the toner is granulated by dispersing an oil phase in an aqueous medium, where the oil phase contains a polyester resin and a colorant, if necessary, further contains the release agent, and the like.

Also, more preferably, the toner is granulated by dispersing an oil phase in an aqueous medium, where the oil phase contains a polyester resin containing at least one of a urethane bond and a urea bond; and a polyester resin not containing urethane bond and urea bond; preferably contains the crystalline polyester resin; and if necessary, further contains the release agent and the colorant.

As one example of such a production method of the toner, a conventionally dissolution suspension method is listed.

As one example of the production method of the toner, a method for forming toner base particles while extending the non-crystalline polyester resin through a chain-elongation reaction and/or cross-linking reaction between the prepolymer and the curing agent will be described hereinafter. In such a method, a preparation of an aqueous medium, preparation of an oil phase containing a toner material, emulsification and/or dispersion of the toner material, and removal of an organic solvent are carried out.

—Preparation of Aqueous Medium (Aqueous Phase)—

The preparation of the aqueous phase can be carried out, for example, by dispersing resin particles in an aqueous medium. An amount of the resin particles in the aqueous medium is not particularly limited and may be appropriately selected depending on the intended purpose, but it is preferably 0.5 parts by mass to 10 parts by mass relative to 100 parts by mass of the aqueous medium.

The aqueous medium is not particularly limited and may be appropriately selected depending on the intended purpose. Examples thereof include water, a solvent miscible with water, and a mixture thereof. These may be used alone or in combination. Among them, water is preferable.

The solvent miscible with water is not particularly limited and may be appropriately selected depending on the intended purpose. Examples thereof include alcohol, dimethyl formamide, tetrahydrofuran, cellosolve, and lower ketone. The alcohol is not particularly limited and may be appropriately selected depending on the intended purpose. Examples thereof include methanol, isopropanol, and ethylene glycol. The lower ketone is not particularly limited and may be appropriately selected depending on the intended purpose. Examples thereof include acetone and methyl ethyl ketone.

—Preparation of Oil Phase—

The oil phase containing the toner materials can be prepared by dissolving or dispersing toner materials in an organic solvent, where the toner materials contain: a polyester resin which is a prepolymer containing at least one of a urethane bond and a urea bond; a polyester resin which does not contain a urethane bond and a urea bond; the crystalline polyester resin; a colorant; and a colorant dispersing resin, and if necessary, further contains the curing agent, the release agent, the colorant, etc.

The organic solvent is not particularly limited and may be appropriately selected depending on the intended purpose, but it is preferably an organic solvent having a boiling point of lower than 150° C., as removal thereof is easy.

The organic solvent having the boiling point of lower than 150° C. is not particularly limited and may be appropriately selected depending on the intended purpose. Examples thereof include liphopholic solvents such as toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, and ethyl acetate; and hydrophilic solvents such as methyl ethyl ketone, and methyl isobutyl ketone. These may be used alone or in combination of two or more thereof.

Among them, ethyl acetate, toluene, xylene, benzene, methylene chloride, 1,2-dichloroethane, chloroform, and carbon tetrachloride are particularly preferable, and ethyl acetate is more preferable.

—Emulsification or Dispersion—

The emulsification or dispersion of the toner materials can be carried out by dispersing the oil phase containing the toner materials in the aqueous medium. In the course of the emulsification or dispersion of the toner material, the curing agent and the prepolymer are allowed to carry out a chain-elongation reaction or cross-linking reaction.

The reaction conditions (e.g., the reaction time and reaction temperature) for generating the prepolymer are not particularly limited and may be appropriately selected depending on a combination of the curing agent and the prepolymer.

The reaction time is not particularly limited and may be appropriately selected depending on the intended purpose, but it is preferably 10 minutes to 40 hours, more preferably 2 hours to 24 hours.

The reaction temperature is not particularly limited and may be appropriately selected depending on the intended purpose, but it is preferably 0° C. to 150° C., more preferably 40° C. to 98° C.

A method for stably forming dispersion liquid in the aqueous medium is not particularly limited and may be appropriately selected depending on the intended purpose. Examples thereof include a method in which an oil phase, which has been prepared by dissolving and/or dispersing a toner material in a solvent, is added to a phase of an aqueous medium, followed by dispersing with shear force.

A disperser used for the dispersing is not particularly limited and may be appropriately selected depending on the intended purpose. Examples thereof include a low-speed shearing disperser, a high-speed shearing disperser, a friction disperser, a high-pressure jetting disperser and an ultrasonic wave disperser.

Among them, the high-speed shearing disperser is preferable, because it can control the particle diameters of the dispersed elements (oil droplets) to the range of 2 μm to 20 μm.

In the case where the high-speed shearing disperser is used, the conditions for dispersing, such as the rotating speed, dispersion time, and dispersion temperature, may be appropriately selected depending on the intended purpose.

The rotational speed is not particularly limited and may be appropriately selected depending on the intended purpose, but it is preferably 1,000 rpm to 30,000 rpm, more preferably 5,000 rpm to 20,000 rpm.

The dispersion time is not particularly limited and may be appropriately selected depending on the intended purpose, but it is preferably 0.1 minutes to 5 minutes in case of a batch system.

The dispersion temperature is not particularly limited and may be appropriately selected depending on the intended purpose, but it is preferably 0° C. to 150° C., more preferably 40° C. to 98° C. under pressure. Note that, generally speaking, dispersion can be easily carried out, as the dispersion temperature is higher.

An amount of the aqueous medium used for the emulsification or dispersion of the toner material is not particularly limited and may be appropriately selected depending on the intended purpose, but it is preferably 50 parts by mass to 2,000 parts by mass, more preferably 100 parts by mass to 1,000 parts by mass, relative to 100 parts by mass of the toner material.

When the amount of the aqueous medium is smaller than 50 parts by mass, the dispersion state of the toner material is impaired, which may result a failure in attaining toner base particles having desired particle diameters. When the amount thereof is greater than 2,000 parts by mass, the production cost may increase.

When the oil phase containing the toner material is emulsified or dispersed, a dispersant is preferably used for the purpose of stabilizing dispersed elements, such as oil droplets, and gives a shape particle size distribution as well as giving desirable shapes of toner particles.

The dispersant is not particularly limited and may be appropriately selected depending on the intended purpose. Examples thereof include a surfactant, a water-insoluble inorganic compound dispersant, and a polymer protective colloid. These may be used alone or in combination of two or more thereof. Among them, the surfactant is preferable.

The surfactant is not particularly limited and may be appropriately selected depending on the intended purpose. Examples thereof include an anionic surfactant, a cationic surfactant, a nonionic surfactant, and an amphoteric surfactant.

The anionic surfactant is not particularly limited and may be appropriately selected depending on the intended purpose. Examples thereof include alkyl benzene sulfonic acid salts, α-olefin sulfonic acid salts and phosphoric acid esters. Among them, those having a fluoroalkyl group are preferable.

—Removal of Organic Solvent—

A method for removing the organic solvent from the dispersion liquid such as the emulsified slurry is not particularly limited and may be appropriately selected depending on the intended purpose Examples thereof include: a method in which an entire reaction system is gradually heated to evaporate out the organic solvent in the oil droplets; and a method in which the dispersion liquid is sprayed in a dry atmosphere to remove the organic solvent in the oil droplets.

As the organic solvent removed, toner base particles are formed. The toner base particles can be subjected to washing and drying, and can be further subjected to classification. The classification may be carried out in a liquid by removing small particles by cyclone, a decanter, or centrifugal separator, or may be performed on particles after drying.

The obtained toner base particles may be mixed with particles such as the external additive, and the charge controlling agent. By applying a mechanical impact during the mixing, the particles such as the external additive can be prevented from fall off from surfaces of the toner base particles.

A method for applying the mechanical impact is not particularly limited and may be appropriately selected depending on the intended purpose. Examples thereof include; a method for applying impulse force to a mixture by a blade rotating at high speed; a method for adding a mixture into a high-speed air flow and accelerating the speed of the flow to thereby make the particles crash into other particles, or make the composite particles crush into an appropriate impact board.

A device used for this method is appropriately selected depending on the intended purpose without any limitation, and examples thereof include ANGMILL (product of Hosokawa Micron Corporation), an apparatus produced by modifying I-type mill (product of Nippon Pneumatic Mfg. Co., Ltd.) to reduce the pulverizing air pressure, a hybridization system (product of Nara Machinery Co., Ltd.), a kryptron system (product of Kawasaki Heavy Industries, Ltd.) and an automatic mortar.

(Developer)

A developer of the present invention contains at least the toner, and may further contain appropriately selected other components, such as carrier, if necessary.

Accordingly, the developer has excellent transfer properties, and charging ability, and can stably form high quality images. Note that, the developer may be a one-component developer, or a two-component developer, but it is preferably a two-component developer when it is used in a high speed printer corresponding to recent high information processing speed, because the service life thereof can be improved.

In the case where the developer is used as a one-component developer, the diameters of the toner particles do not vary largely even when the toner is supplied and consumed repeatedly, the toner does not cause filming to a developing roller, nor fuse to a layer thickness regulating member such as a blade for thinning a thickness of a layer of the toner, and provides excellent and stable developing ability and image even when it is stirred in the developing device over a long period of time.

In the case where the developer is used as a two-component developer, the diameters of the toner particles in the developer do not vary largely even when the toner is supplied and consumed repeatedly, and the toner can provide excellent and stabile developing ability even when the toner is stirred in the developing device over a long period of time.

<Carrier>

The carrier is appropriately selected depending on the intended purpose without any limitation, but it is preferably a earner containing a core, and a resin layer covering the core.

—Core—

A material of the core is appropriately selected depending on the intended purpose without any limitation, and examples thereof include a 50 emu/g to 90 emu/g manganese-strontium (Mn—Sr) material, and a 50 emu/g to 90 emu/g manganese-magnesium (Mn—Mg) material. To secure a sufficient image density, use of a hard magnetic material such as iron powder (100 emu/g or higher), and magnetite (75 emu/g to 120 emu/g) is preferable. Moreover, use of a soft magnetic material such as a 30 emu/g to 80 emu/g copper-zinc material is preferable because an impact applied to a photoconductor by the developer born on a bearer in the form of a brush can be reduced, which is an advantageous for improving image quality.

These may be used alone or in combination of two or more thereof.

The volume average particle diameter of the core is not particularly limited and may be appropriately selected depending on the intended purpose, but it is preferably 10 μm to 150 μm, more preferably 40 μm to 100 μm. When the volume average particle diameter thereof is smaller than 10 μm, the proportion of fine particles in the distribution of carrier particle diameters increases, causing carrier scattering because of low magnetization per carrier particle. When the volume average particle diameter thereof is greater than 150 μm, the specific surface area reduces, which may cause toner scattering, causing reproducibility especially in a solid image portion in a full color printing containing many solid image portions.

In the case where the toner is used for a two-component developer, the toner is used by mixing with the carrier. An amount of the carrier in the two-component developer is not particularly limited and may be appropriately selected depending on the intended purpose, but it is preferably 90 parts by mass to 98 parts by mass, more preferably 93 parts by mass to 97 parts by mass, relative to 100 parts by mass of the two-component developer.

The developer of the present invention may be suitably used in image formation by various known electrophotographies such as a magnetic one-component developing method, a non-magnetic one-component developing method, and a two-component developing method.

<Image Forming Apparatus>

An image forming apparatus of the present invention includes an electrostatic latent image bearer, an electrostatic latent image forming unit configured to form an electrostatic latent image on the electrostatic latent image bearer, and a developing unit containing a toner and configured to develop the electrostatic latent image on the electrostatic latent image bearer to form a visible image, wherein the toner is the toner according to any one of the above (1) to (6).

The developing unit is a unit configured to develop the electrostatic latent image with the toner of the present invention to form a visible image.

FIG. 1 is a schematic view of one example of a two-component developing device using a two-component developer containing the toner of the present invention and a carrier. In FIG. 1, "P" indicates laser light. In this image forming apparatus (100), first, an electrostatic latent image bearer (20) is rotationally driven at a predetermined circumferential speed, and the circumferential surface of the electrostatic latent image bearer (20) is uniformly charged positively or negatively by a charging device (32) to have a predetermined potential. Next, the circumferential surface of the electrostatic latent image bearer (20) is exposed to light by an exposing device (33), so that electrostatic latent images are formed sequentially. Thus, the electrostatic latent image forming unit of this image forming apparatus includes the charging device (32) and the exposing device (33). Furthermore, the electrostatic latent images formed on the circumferential surface of the electrostatic latent image bearer (20) are developed by a developing device (40) using a developer containing the toner of the present invention and a carrier, whereby toner images are formed. Next, the toner images formed on the circumferential surface of the electrostatic latent image bearer (20) are sequentially transferred onto transfer paper sheets which have been synchronized with the rotation of the electrostatic latent image bearer (20) and fed from a paper feeding portion to between the electrostatic latent image bearer (20) and a transfer device (50). Moreover, the transfer paper sheets onto which the toner images have been transferred are separated from the circumferential surface of the electrostatic latent image bearer (20) and introduced to a fixing device where the toner images are fixed on the transfer paper sheets, and then printed out to the outside of the image forming apparatus as copy products (copies). In the meantime, the surface of the electrostatic latent image bearer (20) from which the toner images have been transferred is cleaned by a cleaning device (60) such that the residual toner is removed. Thereafter, the surface of the electrostatic latent image bearer (20) is charge-eliminated by a charge-eliminating device (70) and is used for image formation repeatedly. Note that, "part(s)" and "%" mean "part(s) by mass" and "% by mass", respectively, unless otherwise specified.

EXAMPLES

The present invention will be described with reference to the following Examples. However, it should be noted that the present invention is not limited to these Examples. "Part(s)" mean(s) "part(s) by mass" unless otherwise specifies. "%" means "% by mass" unless otherwise specifies.

Each of the measured values in the following Examples was measured by the methods described herein. Note that, a Tg and a molecular weight of non-crystalline polyester resin A, non-crystalline polyester resin B, and crystalline polyester resin C, and the like were measured by using each of the resins obtained in Production Examples.

Production Example 1

<Synthesis of ketimine>

A reaction container equipped with a stirring rod and a thermometer was charged with isophorone diamine (170 parts) and methyl ethyl ketone (75 parts), followed by reaction at 50° C. for 5 hours, to thereby obtain [ketimine compound 1]. The amine value of the obtained [ketimine compound 1] was found to be 418.

Production Example A-1

Synthesis of Non-Crystalline Polyester Resin A-1

—Synthesis of Prepolymer A-1—

A reaction vessel equipped with a condenser, a stirring device, and a nitrogen-introducing tube was charged with 3-methyl-1,5-pentanediol, isophthalic acid, and adipic acid so that a ratio by mole of hydroxyl group to carboxyl group "OH/COOH" was 1.1; an amount of 3-methyl-1,5-pentanediol was 100% by mole as a diol component; and an amount of isophthalic acid and an amount of adipic acid as a dicarboxylic acid component were 45% by mole and 55% by mole, respectively. Moreover, trimethylolpropane was added together with titanium tetraisopropoxide (1,000 ppm relative to the resin component) so that an amount of the trimethylolpropane was 1.5% by mole relative to the total amount of the monomers. Thereafter, the resultant mixture was heated to 200° C. for about 4 hours, then heated to 230° C. for 2 hours, and allowed to react until no flowing water was formed. Thereafter, the reaction mixture was allowed to further react for 5 hours under a reduced pressure of 10 mmHg to 15 mmHg, to thereby produce intermediate polyester A-1.

Next, a reaction vessel equipped with a condenser, a stirring device, and a nitrogen-introducing tube was charged with the obtained intermediate polyester A-1 and isophorone diisocyanate (IPDI) at a ratio by mole of 2.0 (as the isocyanate group of the IPDI/the hydroxyl group of the intermediate polyester). The resultant mixture was diluted with ethyl acetate so as to be a 50% ethyl acetate solution, followed by reaction at 100° C. for 5 hours, to thereby produce prepolymer A-1.

—Synthesis of Non-Crystalline Polyester Resin A-1—

The obtained prepolymer A-1 was stirred in a reaction vessel equipped with a heating device, a stirring device, and a nitrogen-introducing tube. The [ketimine compound 1] was added dropwise to the reaction vessel in such an amount that the amount by mole of amine in the [ketimine compound 1] was equal to the amount by mole of isocyanate in the prepolymer A-1. The reaction mixture was stirred at 45° C. for 10 hours, and then a polymer product extended was taken out. The obtained polymer product extended was dried at 50° C. under reduced pressure until the amount of the remaining ethyl acetate was 100 ppm or less, to thereby obtain non-crystalline polyester resin A-1.

The resin was found to have a weight average molecular weight (Mw) of 164,000 and Tg of −40° C., respectively.

Production Example A-2

Synthesis of Non-Crystalline Polyester Resin A-2

—Synthesis of Prepolymer A-2—

A reaction vessel equipped with a condenser, a stirring device, and a nitrogen-introducing tube was charged with 3-methyl-1,5-pentanediol and adipic acid so that a ratio by mole of hydroxyl group to carboxyl group "OH/COOH" was 1.1; the amount of 3-methyl-1,5-pentanediol was 100% by mole as a diol component; and the amount of adipic acid component were 100% by mole as a dicarboxylic acid. Moreover, trimethylolpropane was added together with titanium tetraisopropoxide (1,000 ppm relative to the resin component) so that the amount of the trimethylolpropane was 1.5% by mole relative to the total amount of the monomers. Thereafter, the resultant mixture was heated to 200° C. for about 4 hours and then heated to 230° C. for 2 hours, and was allowed to react until no flowing water was formed. Thereafter, the reaction mixture was allowed to further react for 5 hours under a reduced pressure of 10 mmHg to 15 mmHg, to thereby produce intermediate polyester A-2.

Next, a reaction vessel equipped with a condenser, a stirring device, and a nitrogen-introducing tube was charged with the obtained intermediate polyester A-2 and isophorone diisocyanate (IPDI) at a ratio by mole of 2.0 (as the isocyanate group of the IPDI/the hydroxyl group of the intermediate polyester). The resultant mixture was diluted with ethyl acetate so as to be a 50% ethyl acetate solution, followed by reaction at 100° C. for 5 hours, to thereby produce prepolymer A-2.

—Synthesis of Non-Crystalline Polyester Resin A-2—

The obtained prepolymer A-2 was stirred in a reaction vessel equipped with a heating device, a stirring device, and a nitrogen-introducing tube. The [ketimine compound 1] was added dropwise to the reaction vessel in such an amount that the amount by mole of amine in the [ketimine compound 1] was equal to the amount by mole of isocyanate in the prepolymer A-2. The reaction mixture was stirred at 45° C. for 10 hours, and then a polymer product extended was taken out. The obtained polymer product extended was dried at 50° C. under reduced pressure until the amount of the remaining ethyl acetate was 100 ppm or less, to thereby obtain non-crystalline polyester resin A-2. The resin was found to have a weight average molecular weight (Mw) of 175,000 and Tg of −55° C., respectively.

Production Example A-3

Synthesis of Non-Crystalline Polyester Resin A-3—

—Synthesis of Prepolymer A-3—

A reaction vessel equipped with a condenser, a stirring device, and a nitrogen-introducing tube was charged with bisphenol A ethylene oxide 2 mole adduct, bisphenol A propylene oxide 2 mole adduct, terephthalic acid, and trimellitic anhydride so that a ratio by mole of hydroxyl group to carboxyl group "OH/COOH" was 1.3; bisphenol A ethylene oxide 2 mole adduct and bisphenol A propylene oxide 2 mole adduct were 90% by mole and 10% by mole as a diol component, respectively; and the amount of terephthalic acid and the amount of trimellitic anhydride were 90% by mole and 10% by mole as a dicarboxylic acid component, respectively. Moreover, titanium tetraisopropoxide (1,000 ppm relative to the resin component) was added thereto. Thereafter, the resultant mixture was heated to 200° C. for about 4 hours and then heated to 230° C. for 2 hours, and was allowed to react until no flowing water was formed. Thereafter, the reaction mixture was allowed to further react for 5 hours under a reduced pressure of 10 mmHg to 15 mmHg, to thereby produce intermediate polyester A-3.

Next, a reaction vessel equipped with a condenser, a stirring device, and a nitrogen-introducing tube was charged with the obtained intermediate polyester A-3 and isophorone diisocyanate (IPDI) at a ratio by mole of 2.0 (as the isocyanate group of the IPDI/the hydroxyl group of the intermediate polyester). The resultant mixture was diluted with ethyl acetate so as to be a 50% ethyl acetate solution, followed by reaction at 100° C. for 5 hours, to thereby produce prepolymer A-3.

—Synthesis of Non-Crystalline Polyester Resin A-3—

The obtained prepolymer A-3 was stirred in a reaction vessel equipped with a heating device, a stirring device, and a nitrogen-introducing tube. The [ketimine compound 1] was added dropwise to the reaction vessel in such an amount that the amount by mole of amine in the [ketimine compound 1] was equal to the amount by mole of isocyanate in the prepolymer A-3. The reaction mixture was stirred at 45° C. for 10 hours, and then a polymer product extended was taken out. The obtained polymer product extended was dried at 50° C. under reduced pressure until the amount of the remaining ethyl acetate was 100 ppm or less, to thereby obtain non-crystalline polyester resin A-3. The resin was found to have a weight average molecular weight (Mw) of 130,000 and Tg of 54° C.

Production Example A-4

Synthesis of Non-Crystalline Polyester Resin A-4—

—Synthesis of Prepolymer A-4—

A reaction vessel equipped with a condenser, a stirring device, and a nitrogen-introducing tube was charged with 3-methyl-1,5-pentanediol, isophthalic acid, adipic acid, and trimellitic anhydride so that a ratio by mole of hydroxyl group to carboxyl group "OH/COOH" was 1.5; the amount of 3-methyl-1,5-pentanediol was 100% by mole as a diol component; the amount of isophthalic acid and the amount of adipic acid were 40% by mole and 60% by mole as a dicarboxylic acid component, respectively; and the amount of trimellitic anhydride was 1% by mole relative to the total amount of the monomers. Moreover, titanium tetraisopropoxide (1,000 ppm relative to the resin component) was added thereto. Thereafter, the resultant mixture was heated to 200° C. for about 4 hours, then heated to 230° C. for 2 hours, and was allowed to react until no flowing water was formed. Thereafter, the reaction mixture was allowed to further react for 5 hours under a reduced pressure of 10 mmHg to 15 mmHg, to thereby produce intermediate polyester A-4.

Next, a reaction vessel equipped with a condenser, a stirring device, and a nitrogen-introducing tube was charged with the obtained intermediate polyester A-4 and isophorone diisocyanate (IPDI) at a ratio by mole of 2.0 (as the isocyanate group of the IPDI/the hydroxyl group of the intermediate polyester). The resultant mixture was diluted with ethyl acetate so as to be a 50% ethyl acetate solution, followed by reaction at 100° C. for 5 hours, to thereby produce prepolymer A-4.

—Synthesis of Non-Crystalline Polyester Resin A-4—

The obtained prepolymer A-4 was stirred in a reaction vessel equipped with a heating device, a stirring device, and a nitrogen-introducing tube. The [ketimine compound 1] was added dropwise to the reaction vessel in such an amount that the amount by mole of amine in the [ketimine compound 1] was equal to the amount by mole of isocyanate in the prepolymer A-4. The reaction mixture was stirred at 45° C. for 10 hours, and then a polymer product extended was taken out. The obtained polymer product extended was dried at 50° C. under reduced pressure until the amount of the remaining ethyl acetate was 100 ppm or less, to thereby obtain non-crystalline polyester resin A-4. The resin was found to have a weight average molecular weight (Mw) of 150,000 and Tg of −35° C.

Production Example B-1

Synthesis of Non-Crystalline Polyester Resin B-1

A four-necked flask equipped with a nitrogen-introducing tube, a dehydration tube, a stirring device, and a thermocouple was charged with bisphenol A ethylene oxide 2 mole adduct, bisphenol A propylene oxide 2 mole adduct, terephthalic acid, and adipic acid so that a ratio by mole of bisphenol A propylene oxide 2 mole adduct to bisphenol A ethylene oxide 2 mole adduct (bisphenol A propylene oxide 2 mole adduct/bisphenol A ethylene oxide 2 mole adduct) was 60/40, a ratio by mole of terephthalic acid and adipic acid (terephthalic acid/adipic acid) was 97/3, and a ratio by mole of hydroxyl group to carboxyl group "OH/COOH" was 1.3. Moreover, titanium tetraisopropoxide (500 ppm relative to the resin component) was added thereto, and the resultant mixture was allowed to react under normal pressure at 230° C. for 8 hours and then to further react under a reduced pressure of 10 mmHg to 15 mmHg for 4 hours. Trimellitic anhydride was added to the reaction vessel so that an amount thereof was 1% by mole relative to the total resin components, followed by reaction at 180° C. under normal pressure for 3 hours, to thereby obtain amorphous polyester resin B-1. The resin was found to have a weight average molecular weight (Mw) of 5,300 and Tg of 67° C.

Production Example B-2

Synthesis of Non-Crystalline Polyester Resin B-2

A four-necked flask equipped with a nitrogen-introducing tube, a dehydration tube, a stirring device, and a thermocouple was charged with bisphenol A propylene oxide 2 mole adduct, 1,3-propylene glycol, terephthalic acid, and adipic acid so that a ratio by mole of bisphenol A propylene oxide 2 mole adduct to 1,3-propylene glycol (bisphenol A propylene oxide 2 mole adduct/1,3-propylene glycol) was 90/10, a ratio by mole of terephthalic acid to adipic acid (terephthalic acid/adipic acid) was 80/20, and a ratio by mole of hydroxyl group to carboxyl group "OH/COOH" was 1.4. Moreover, titanium tetraisopropoxide (500 ppm relative to the resin component) was added thereto, then the resultant mixture was allowed to react under normal pressure at 230° C. for 8 hours, and then to further react under a reduced pressure of 10 mmHg to 15 mmHg for 4 hours. Trimellitic anhydride was added to the reaction vessel so that an amount thereof was 1% by mole relative to the total resin components, followed by reaction at 180° C. under normal pressure for 3 hours, to thereby obtain non-crystalline polyester resin B-2. The resin was found to have a weight average molecular weight (Mw) of 5,600 and Tg of 61° C.

Production Example B-3

Synthesis of Non-Crystalline Polyester Resin B-3

A four-necked flask equipped with a nitrogen-introducing tube, a dehydration tube, a stirring device, and a thermocouple was charged with bisphenol A propylene oxide 2 mole adduct, bisphenol A ethylene oxide 2 mole adduct, isophthalic acid, and adipic acid so that a ratio by mole of bisphenol A propylene oxide 2 mole adduct to bisphenol A ethylene oxide 2 mole adduct (bisphenol A propylene oxide 2 mole adduct/bisphenol A ethylene oxide 2 mole adduct) was 30/70, a ratio by mole of isophthalic acid to adipic acid (isophthalic acid/adipic acid) was 80/20, and a ratio by mole of hydroxyl group to carboxyl group "OH/COOH" was 1.2. Moreover, titanium tetraisopropoxide (500 ppm relative to the resin component) was added thereto, and the resultant mixture was allowed to react under normal pressure at 230° C. for 8 hours and then to further react under a reduced pressure of 10 mmHg to 15 mmHg for 4 hours. Trimellitic anhydride was added to the reaction vessel so that an amount thereof was 1% by mole relative to the total resin components, followed by reaction at 180° C. under normal pressure for 3 hours, to thereby obtain non-crystalline polyester resin B-3. The resin was found to have a weight average molecular weight (Mw) of 5,500 and Tg of 50° C.

Production Example B-4

Synthesis of Non-Crystalline Polyester Resin B-4

A four-necked flask equipped with a nitrogen-introducing tube, a dehydration tube, a stirring device, and a thermocouple was charged with bisphenol A ethylene oxide 2 mole adduct, bisphenol A propylene oxide 3 mole adduct, isophthalic acid, adipic acid so that a ratio by mole of bisphenol A ethylene oxide 2 mole adduct to bisphenol A propylene oxide 3 mole adduct (bisphenol A ethylene oxide 2 mole adduct/bisphenol A propylene oxide 3 mole adduct) was 85/15, a ratio by mole of isophthalic acid to adipic acid (isophthalic acid/adipic acid) was 80/20, and a ratio by mole of hydroxyl group to carboxyl group "OH/COOH" was 1.3. Moreover, titanium tetraisopropoxide (500 ppm relative to the resin component) was added thereto, and the resultant mixture was allowed to react under normal pressure at 230° C. for 8 hours and then to further react under a reduced pressure of 10 mmHg to 15 mmHg for 4 hours. Trimellitic anhydride was added to the reaction vessel so that an amount thereof was 1% by mole relative to the total resin components, followed by reaction at 180° C. under normal pressure for 3 hours, to thereby obtain non-crystalline polyester resin B-4. This resin was found to have a weight average molecular weight (Mw) of 5,000 and a Tg of 48° C.

Production Example C

Synthesis of Crystalline Polyester Resin C-1

A four-necked flask of 5 L equipped with a nitrogen-introducing tube, a dehydration tube, a stirring device, and a thermocouple was charged with sebacic acid and 1,6-hexanediol so that a ratio by mole of hydroxyl group to carboxyl group "OH/COOH" was 0.9. Moreover, titanium tetraisopropoxide (500 ppm relative to the resin component) was added thereto, and the resultant mixture was allowed to react under normal pressure at 180° C. for 10 hours, heated to 200° C., allowed to react 3 hours, and then to react under a pressure of 8.3 kPa for 2 hours to thereby obtain a crystalline polyester resin C-1. This resin was found to have a weight average molecular weight (Mw) of 25,000 and a melting point of 67° C.

[Synthesis of Colorant Dispersing Resin B1]

A four-necked flask of 5 L equipped with a nitrogen-introducing tube, a dehydration tube, a stirring device, and a thermocouple was charged with 62.5 parts by mass of terephthalic acid, 14.0 parts by mass of ethylene glycol, 23.5 parts by mass of neopentylglycol, and 0.2 parts by mass of dibutyltin oxide. The resultant mixture was allowed to react 180° C. for 10 hours, heated to 200° C., allowed to react for 3 hours, and then to react under a pressure of 8.3 kPa for 2 hours, to thereby obtain [colorant dispersing resin B1].

[Synthesis of Colorant Dispersing Resin B2]

To a four-necked flask of 5 L equipped with a nitrogen-introducing tube, a reflux tube, a stirring device, and a thermocouple, 70 parts by mass of the colorant dispersing resin B1, 30 parts by mass of crystalline polyester resin, and 100 parts by mass of toluene were added, and uniformly dissolved at 60° C. Then, 0.2 parts by mass of dibutyltin oxide and 5 parts by mass of diphenylmethane diisocyanate was added to the resultant mixture, and allowed to react 80° C. for 4 hours. Toluene was distil away from the reactant at 120° C. under a pressure of 1 kPa, to thereby obtain [colorant dispersing resin B2].

[Synthesis of Colorant Dispersing Resin B3]

Colorant dispersing resin B3 was synthesized in the same manner as in the synthesis of colorant dispersing resin B1 except that the amount of the materials charged were changed as shown in Table 1 below.

TABLE 1

| Kinds | B1 | B3 |
|---|---|---|
| Terephthalic acid | 62.5 | 64.5 |
| Isophthalic acid | 0 | 0 |

TABLE 1-continued

| Kinds | B1 | B3 |
|---|---|---|
| Ethylene glycol | 14 | 0 |
| Neopentylglycol | 23.5 | 0 |
| Propylene glycol | 0 | 26.6 |
| 1,3-Propanediol | 0 | 8.9 |
| Dibutyltin oxide | 0.2 | 0.2 |

T(60), T(480), and T(60)-T(480) of the obtained colorant dispersing resins were shown in Table 2.

TABLE 2

| | T(60) | T(480) | T(60) − T(480) |
|---|---|---|---|
| B1 | 38 | 1 | 37 |
| B2 | 88 | 86 | 2 |
| B3 | 2 | 1 | 1 |

[Production of Colorant (Pigment A1)]

In 1500 parts of water, 84 parts of 3-amino-4-methoxybenzanilide was dispersed, and the temperature condition was adjusted to be 0° C. or lower by the addition of ice. Then, 125 parts of a 35% aqueous hydrochloric acid solution was added to the mixture, followed by stirring for 1 hour, to thereby be formed into a hydrochloride. Next, 61.5 parts of a 40% aqueous sodium nitrite solution was added to the mixture, which was then stirred for 1 hour. Thereafter, 4 parts of sulfamic acid was added to the mixture to decompose extra nitrous acid, to thereby prepare an aqueous diazonium solution.

Meanwhile, 124.5 of a wet cake (in a dried state) of N-(2'-methyl-5'-chlorophenyl)-3-hydroxy-2-naphthalenecarboxyamide alkaline compound, serving as a coupling component was added to water (1,000 parts), and followed by dispersing therein. Sodium dodecyl sulfonate (1 part) serving as a particle controlling agent for pigment particles was added to the mixture, and water was added thereto to adjust the temperature to 20° C., whereby a coupler solution was prepared.

While this coupler solution was being kept at 20° C., the above-prepared aqueous diazonium solution was gradually added dropwise thereto. Coupling reaction was allowed to take place while the pH of the liquid was being kept at a pH of 11.5±0.5, followed by stirring for 1 hour to complete the reaction.

After 1 hour, disappearance of the diazonium was confirmed by high-performance liquid chromatography, and an appropriate amount of a 35% aqueous hydrochloric acid solution was added to the reaction mixture to adjust the pH thereof to 7.0 to 7.5. The obtained slurry was thermally treated by being stirred for 1 hour at 100° C., followed by filtration, washing with water, drying at 90° C. to 100° C., and pulverizing, to thereby obtain pigment A1 (Pigment Red 269).

The amine value of the obtained pigment A1 was found to be 0.7 mg KOH/mg.

—Preparation of Master Batch (MB)—

[Magenta Master Batch A]

Water (100 parts), 40 parts of pigment A1, and 60 parts of the colorant dispersing resin B1 were mixed and stirred. The resultant mixture was kneaded by a twin roll at 150° C. for 10 minutes, followed by kneading at 100° C. for 20 minutes. The resulting kneaded product was rolled out and cooled, followed by pulverizing a pulverizer (product of Hosokawa Micron Corporation), to thereby prepare magenta master batch A.

[Magenta Master Batch B]

Magenta master batch B was prepared in the same manner as in magenta master batch A except that the amount of the materials charged was adjusted as shown in Table 3 below.

TABLE 3

| | Magenta master batch | | | | | |
|---|---|---|---|---|---|---|
| | A | B | C | D | E | F |
| Pigment A1 | 20 | 10 | 50 | 20 | 20 | 0 |
| Pigment A2 | 0 | 0 | 0 | 0 | 0 | 20 |
| Colorant dispersing resin B1 | 80 | 90 | 50 | 0 | 0 | 80 |
| Colorant dispersing resin B2 | 0 | 0 | 0 | 80 | 0 | 0 |
| Colorant dispersing resin B3 | 0 | 0 | 0 | 0 | 80 | 0 |
| Water | 100 | 100 | 100 | 100 | 100 | 100 |

[Magenta Master Batch C1]

Magenta master batch C was prepared in the same manner as in magenta master batch A except that the amount of the materials charged was adjusted as shown in Table 3 above.

[Magenta Master Batch D]

Magenta master batch D was prepared in the same manner as in magenta master batch A except that the amount of the materials charged was adjusted as shown in Table 3 above.

[Magenta Master Batch E]

Magenta master batch E was prepared in the same manner as in magenta master batch A except that the amount of the materials charged was adjusted as shown in Table 3 above.

[Magenta Master Batch F]

Magenta master batch E was prepared in the same manner as in magenta master batch A except that pigment A1 was changed to pigment A2 (PR269 (1022 KB: product of DIC) as shown in Table 3 above. The amine value of the pigment A2 was found to be 4.3 mg KOH/mg.

[Black Master Batch]

Water (1000 parts by mass), 40 parts by mass of carbon black (PRINTEX35, product of Evonik Degussa Japan Co., Ltd., DBP oil absorption amount=42 mL/100 g, pH=9.5), and 60 parts by mass of the colorant dispersing resin B1 were mixed and stirred. The resulting mixture was kneaded by a twin roll at 150° C. for 10 minutes, allowed by kneading at 100° C. for 20 minutes. The resulting kneaded product was rolled out and cooled, followed by pulverizing a pulverizer (product of Hosokawa Micron Corporation), to thereby prepare black master batch.

[Yellow Master Batch]

Water (100 parts), 40 parts by mass of yellow pigment (C.I.Pigment yellow 185, product of BASF), and 60 parts by mass of mass of the colorant dispersing resin B1 were mixed and stirred. The resulting mixture was kneaded at 150° C. for 10 minutes, followed by kneading at 100° C. for 20 minutes. The resulting kneaded mixture was rolled out and cooled, followed by pulverizing a pulverizer (product of Hosokawa Micron Corporation), to thereby prepare yellow master batch.

[Cyan Master Batch]

Water (100 parts), 40 parts by mass of cyan pigment (C.I.Pigment Blue 15:3, product of Dainichiseika Color & Chemicals Mfg. Co., Ltd.), and 60 parts by mass of the colorant dispersing resin B1 were mixed and stirred. The resulting mixture was kneaded by a twin roller at 150° C. for 10 minutes, and then kneaded at 100° C. for 20 minutes. The resulting kneaded product was rolled out and cooled, followed by pulverizing a pulverizer (product of Hosokawa Micron Corporation), to thereby prepare cyan master batch.

Example 1

<Production of WAX Dispersion Liquid>

A vessel to which a stirring bar and a thermometer had been set was charged with 50 parts of paraffin wax (HNP-9, product of Nippon Seiro Co., Ltd., hydrocarbon wax, melting point: 75° C., SP value: 8.8) as a release agent 1, and 450 parts of ethyl acetate, followed by heating to 80° C. with stirring. The temperature was maintained at 80° C. for 5 hours, followed by cooling to 30° C. for 1 hour. The resulting mixture was dispersed by a bead mill (ULTRA VISCOMILL, product of AIMEX CO., Ltd.) under the conditions: a liquid feed rate of 1 kg/hr, disc circumferential velocity of 6 m/s, 0.5 mm-zirconia beads packed to 80% by volume, and 3 passes, to thereby obtain [WAX dispersion liquid 1].

<Production of Crystalline Polyester Resin Dispersion Liquid>

A vessel to which a stirring bar and a thermometer had been set was charged with 50 parts of the crystalline polyester resin C-1, 450 parts of ethyl acetate, followed by heating to 80° C. with stirring. The temperature was maintained at 80° C. for 5 hours, followed by cooling to 30° C. over 1 hour. The resulting mixture was dispersed by a bead mill (ULTRA VISCOMILL, product of AIMEX CO., Ltd.) under the conditions: a liquid feed rate of 1 kg/hr, disc circumferential velocity of 6 m/s, 0.5 mm-zirconia beads packed to 80% by volume, and 3 passes, to thereby obtain [crystalline polyester resin dispersion liquid 1].

<Preparation of Oil Phase>

Into a vessel, 50 parts of the [WAX dispersion liquid 1], 150 parts of the [non-crystalline polyester resin A-1], 50 parts of the [crystalline polyester resin dispersion liquid 1], 750 parts of the [non-crystalline polyester resin B-1], 30 parts of the [magenta master batch A], and 2 parts of the [ketimine compound 1] were charged, followed by mixing by a TK Homomixer (product of PRIMIX Corporation) at 5,000 rpm for 60 minutes, to thereby obtain [oil phase 1].

Note that, the amounts described above each mean an amount of a solid content in each of the materials.

<Synthesis of Organic Particle Emulsion (Particle Dispersion Liquid)>

A reaction vessel equipped with a stirring bar and a thermometer was charged with 683 parts of water, 11 parts of a sodium salt of sulfuric acid ester of methacrylic acid-ethylene oxide adduct (ELEMINOL RS-30, product of Sanyo Chemical Industries, Ltd.), 138 parts of styrene, 138 parts of methacrylic acid, and 1 part of ammonium persulfate, and the resulting mixture was stirred for 15 minutes at 400 rpm, to thereby obtain a white emulsion. The obtained emulsion was heated to have the system temperature of 75° C., and was then allowed to react for 5 hours. To the resultant, 30 parts of a 1% ammonium persulfate aqueous solution was added, followed by aging for 5 hours at 75° C., to thereby obtain an aqueous dispersion liquid of a vinyl resin (a copolymer of styrene/methacrylic acid/sodium salt of sulfuric acid ester of methacrylic acid ethylene oxide adduct), i.e., [particle dispersion liquid 1].

The [particle dispersion liquid 1] was measured by LA-920 (product of HORIBA, Ltd.), and as a result, the volume average particle diameter thereof was found to be 0.14 μm. Part of the [particle dispersion liquid 1] was dried, and a resin component thereof was isolated.

<Preparation of Aqueous Phase 1>

Water (990 parts), 83 parts of the [particle dispersion liquid 1], 37 parts of a 48.5% aqueous solution of sodium dodecyldiphenyl ether disulfonate (ELEMINOL MON-7, product of Sanyo Chemical Industries Ltd.), and 90 parts of ethyl acetate were mixed and stirred, to thereby obtain an opaque white liquid. The obtained liquid was used as [aqueous phase 1].

<Emulsification and Removal of Solvent>

To a container charged with the [oil phase 1], 1,200 parts of the [aqueous phase 1] was added, and the resulting mixture was mixed by a TK Homomixer at 13,000 rpm for 20 minutes, to thereby obtain [emulsified slurry 1].

A container equipped with a stirrer and a thermometer was charged with the [emulsified slurry 1], followed by removing the solvent therein at 30° C. for 8 hours. Thereafter, the resultant was matured at 45° C. for 4 hours, to thereby obtain [dispersion slurry 1].

<Washing and Drying>

After subjecting 100 parts of the [dispersion slurry 1] to filtration under the reduced pressure, the obtained cake was subjected twice to a series of treatments (1) to (4) described below, to thereby produce [filtration cake 1]:

(1): ion-exchanged water (100 parts) was added to the filtration cake, followed by mixing with TK Homomixer (at 12,000 rpm for 10 minutes) and then filtration;

(2): 10% sodium hydroxide aqueous solution (100 parts) was added to the filtration cake obtained in (1), followed by mixing with TK Homomixer (at 12,000 rpm for 30 minutes) and then filtration under reduced pressure;

(3): 10% by mass hydrochloric acid (100 parts) was added to the filtration cake obtained in (2), followed by mixing with TK Homomixer (at 12,000 rpm for 10 minutes) and then filtration; and (4): ion-exchanged water (300 parts) was added to the filtration cake obtained in (3), followed by mixing with TK Homomixer (at 12,000 rpm for 10 minutes) and then filtration.

Next, the [filtration cake 1] was dried with an air-circulating drier at 45° C. for 48 hours, and then was caused to pass through a sieve with a mesh size of 75 μm, to thereby obtain [toner base particles 1].

—Treatment with External Additives—

The [toner base particles 1] (100 parts by mass), 0.6 parts by mass of hydrophobic silica having an average particle diameter of 100 nm, 1.0 part by mass of titanium oxide having an average particle diameter of 20 nm, and 0.8 parts by mass of hydrophobic silica fine powder having an average particle diameter of 15 nm were mixed together in a Henschel mixer to thereby obtain a toner of Example 1.

A component ratio of the obtained toner was shown in Table 4.

TABLE 4

| | Non-crystalline polyester resin A | | Non-crystalline polyester resin B | | Crystalline polyester resin C-1 | Master batch | | Colorant dispersing resin |
|---|---|---|---|---|---|---|---|---|
| | Kinds | Parts by mass | Kinds | Parts by mass | Parts by mass | Kinds | Parts by mass | Kinds |
| Ex. 1 | A-1 | 150 | B-1 | 750 | 50 | MA | 30 | B1 |
| Ex. 2 | A-1 | 120 | B-1 | 820 | 10 | MA | 30 | B1 |
| Ex. 3 | A-2 | 150 | B-3 | 750 | 50 | MA | 30 | B1 |

TABLE 4-continued

| | Non-crystalline polyester resin A | | Non-crystalline polyester resin B | | Crystalline polyester resin C-1 | Master batch | | Colorant dispersing resin |
|---|---|---|---|---|---|---|---|---|
| | Kinds | Parts by mass | Kinds | Parts by mass | Parts by mass | Kinds | Parts by mass | Kinds |
| Ex. 4 | A-3 | 150 | B-2 | 750 | 50 | MA | 30 | B1 |
| Ex. 5 | A-1 | 210 | B-1 | 750 | 50 | MC | 30 | B1 |
| Ex. 6 | A-1 | 40 | B-1 | 750 | 50 | MB | 30 | B1 |
| Ex. 7 | A-1 | 120 | B-2 | 780 | 50 | MA | 30 | B1 |
| Ex. 8 | A-2 | 180 | B-3 | 720 | 50 | MA | 30 | B1 |
| Ex. 9 | A-1 | 150 | B-1 | 750 | 50 | K | 30 | B1 |
| Ex. 10 | A-1 | 150 | B-1 | 750 | 50 | Y | 30 | B1 |
| Ex. 11 | A-1 | 150 | B-1 | 750 | 50 | C | 30 | B1 |
| Ex. 12 | A-1 | 150 | B-1 | 750 | 50 | MF | 30 | B1 |
| Ex. 13 | A-1 | 150 | B-1 | 750 | 50 | ME | 30 | B3 |
| Comp. Ex. 1 | A-1 | 70 | B-1 | 850 | 50 | MA | 30 | B1 |
| Comp. Ex. 2 | A-1 | 750 | B-1 | 150 | 50 | MA | 30 | B1 |
| Comp. Ex. 3 | A-1 | 150 | B-1 | 750 | 50 | MD | 30 | B2 |
| Comp. Ex. 4 | A-4 | 150 | B-3 | 750 | 0 | MA | 30 | B1 |

In Table 4 described above, MA means magenta master batch A, MB means magenta master batch B, MC means magenta master batch C, MD means magenta master batch D, ME means magenta master batch E, MF means magenta master batch F, K means black master batch, Y means yellow master batch, and C means cyan master batch.

[Tg1st (toner)], [Tg2nd (toner)], [Tg2nd (THF insoluble matter)], [G'(100)(THF insoluble matter)], and [[G'(40)(THF insoluble matter)]/[G'(100)(THF insoluble matter)]] of the obtained toner were shown in Table 5.

TABLE 5

| | Toner Tg1st (° C.) | THF insoluble matter Tg2nd (° C.) | Localized state | [G'(100)(THF insoluble matter)] | [(G'(40)(THF insoluble matter)]/[G'(100)(THF insoluble matter)] | Toner Tg2nd (° C.) |
|---|---|---|---|---|---|---|
| Ex. 1 | 43 | 3 | 34 | $5.0 \times 10^5$ | $3.1 \times 10$ | 22 |
| Ex. 2 | 47 | −1 | 35 | $4.8 \times 10^6$ | $3.4 \times 10$ | 29 |
| Ex. 3 | 27 | −13 | 32 | $3.9 \times 10^5$ | $2.3 \times 10$ | 4 |
| Ex. 4 | 48 | 29 | 40 | $8.5 \times 10^4$ | $1.5 \times 10^2$ | 31 |
| Ex. 5 | 40 | 5 | 49 | $4.5 \times 10^5$ | $2.9 \times 10$ | 24 |
| Ex. 6 | 42 | 4 | 25 | $3.7 \times 10^5$ | $3.1 \times 10$ | 22 |
| Ex. 7 | 44 | 6 | 40 | $6.0 \times 10^6$ | $3.4 \times 10$ | 26 |
| Ex. 8 | 40 | −13 | 25 | $2.8 \times 10^5$ | $2.6 \times 10$ | 18 |
| Ex. 9 | 41 | 3 | 21 | $5.6 \times 10^5$ | $3.3 \times 10$ | 22 |
| Ex. 10 | 42 | 7 | 32 | $5.5 \times 10^5$ | $3.1 \times 10$ | 23 |
| Ex. 11 | 43 | 5 | 23 | $4.2 \times 10^5$ | $3.0 \times 10$ | 22 |
| Ex. 12 | 42 | 4 | 45 | $4.1 \times 10^5$ | $3.0 \times 10$ | 25 |
| Ex. 13 | 43 | 4 | 20 | $5.7 \times 10^5$ | $3.3 \times 10$ | 21 |
| Comp. Ex. 1 | 61 | −38 | 44 | $4.5 \times 10^5$ | $3.2 \times 10$ | 53 |
| Comp. Ex. 2 | −30 | −45 | 40 | $2.5 \times 10^5$ | $3.4 \times 10$ | −33 |
| Comp. Ex. 3 | 42 | 5 | 60 | $5.2 \times 10^5$ | $3.2 \times 10$ | 22 |
| Comp. Ex. 4 | 52 | 35 | 47 | $8.0 \times 10^4$ | $7.0 \times 10$ | 51 |

<Evaluation>

Each of the obtained toners in Examples and Comparative Examples described above was used to prepare a developer as follows, and each of the properties thereof was evaluated. Results are shown in Table 6.

<<Production of Developer>>

—Production of Carrier—

To 100 parts of toluene, 100 parts of silicone resin (organo straight silicone), 5 parts of γ-(2-aminoethyl)aminopropyltrimethoxy silane, and 10 parts of carbon black were added, and then, the resultant mixture was dispersed by a homomixer for 20 minutes, to thereby prepare a resin layer coating liquid. To surfaces of spherical magnetite particles having the average particle diameter of 50 μm (1,000 parts by mass), the resin layer coating liquid was applied by a fluidized bed coating device, to thereby prepare a carrier.

—Production of Developer—

Using a ball mill, each of the obtained toner (5 parts) and each of the carrier (95 parts) were mixed to thereby prepare a developer.

<Heat Resistant Storage Stability (Penetration Degree)>

Each of the toners was charged into a 50 mL-glass container, which was then left to stand in a thermostat bath of 50° C. for 24 hours, followed by cooling to 24° C. The thus-treated toner was measured for a penetration degree (mm) according to the penetration test (JIS K2235-1991) and evaluated for heat resistant storage stability according to the following criteria. Note that, the greater penetration degree indicates the more excellent heat resistant storage stability. In cases where penetration degree is less than 5 mm, the problems may be occurred in use.

In the present invention, a penetration degree means a degree of well penetration.

[Evaluation Criteria]

A: The penetration degree is 20 mm or greater but less than 25 mm.

B: The penetration degree is 10 mm or greater but less than 20 mm.

C: The penetration degree is 5 mm or greater but less than 10 mm.

D: The penetration degree is less than 5 mm.

(Examination of Image)

The [toner 1] obtained by the above method was mixed with a carrier used in IMAGEO MP C4300 (product of Ricoh Company, Ltd.) so that the toner concentration was 5%, followed by charging into a yellow unit of the image forming apparatus so that a weight of the developer was 180 g.

Using the developer, a rectangular solid image of 2 cm×15 cm was formed on paper having a size of A4 (T6000 70 W long grain, product of Ricoh Company, Ltd.) so that the toner was deposited in an amount of 0.40 mg/cm$^2$ and the surface temperature of the fixing roller was set to 120° C. The image density (ID) of the fixed image was measured by X-RITE938 (product of X-Rite Co.) under the conditions: status A mode and d50 light. When the yellow toner was used, the image density (ID) thereof was measured; when the magenta toner was used, the image density (ID) thereof was measured; when the cyan toner was used, the image density (ID) thereof was measured; and when the black toner was used, the image density (ID) thereof was measured.

<<ID (Image Density)>>

Using the evaluation result of the ID, each toner was evaluated as follows.

A: ID is 1.5 or greater.

B: ID is 1.4 or greater but less than 1.5.

C: ID is 1.2 or greater but less than 1.4.

D: ID is less than 1.2.

<<Low Temperature Fixing Ability>>

In cases where an image remaining after development of the solid image which was fixed from an image bearer to paper medium, was fixed in other places than the intended places (cold offset and hot offset), it was determined as "NG". While in cases where these offsets were not observed, it was determined as "OK". In cases where the offsets were not observed, the fixing temperature was evaluated based on the following evaluation criteria.

[Evaluation Criteria]

A; More than 105° C. but 110° C. or less

B: More than 110° C. but 115° C. or less

C: More than 115° C. but 130° C. or less

D: More than 130° C.

TABLE 6

| | Heat resistant storage stability | Low temperature fixing ability | ID |
|---|---|---|---|
| Example 1 | A | A | A |
| Example 2 | A | C | A |
| Example 3 | C | A | A |
| Example 4 | C | C | B |
| Example 5 | A | C | C |
| Example 6 | C | A | A |
| Example 7 | B | C | B |
| Example 8 | B | C | B |
| Example 9 | A | A | A |
| Example 10 | A | A | A |
| Example 11 | A | A | A |
| Example 12 | A | B | B |
| Example 13 | C | A | C |
| Comparative Example 1 | A | D | B |
| Comparative Example 2 | D | A | B |
| Comparative Example 3 | A | D | D |
| Comparative Example 4 | A | D | C |

Examples 2 to 13

Toners of Examples 2 to 13 were each obtained in the same manner as in Example 1 except that the compositional ratio of Example 1 was changed to each of the compositional ratios (shown in Table 4) of the toners. Properties of the toners of Examples 2 to 13 were evaluated in the same manner as in Example 1. Results are shown in Table 5 and Table 6.

Comparative Examples 1 to 4

Toners of Comparative Examples 1 to 4 were each obtained in the same manner as in Example 1 except that the compositional ratio of Example 1 was changed to each of the compositional ratios (shown in Table 4) of the toners. Properties of the toners of Comparative Examples 1 to 4 were evaluated in the same manner as in Example 1. Results are shown in Table 5 and Table 6.

This application claims priority to Japanese application No. 2014-040480, filed on Mar. 3, 2014, and incorporated herein by reference; Japanese application No. 2014-143975, filed on Jul. 14, 2014, and incorporated herein by reference; and No. 2015-018159, filed on Feb. 2, 2015, and incorporated herein by reference.

What is claimed is:

1. A toner, comprising:

base particles, comprising:

a noncrystalline nonlinear polyester resin (A) having at least one of a urethane and a urea bond and a glass transition temperature ($T_g$) of from −60° C. to 0° C.;

a noncrystalline polyester resin (B) having a $T_g$ of from 40 to 80° C.;

a crystalline polyester resin (C) having a melting point of from 60 to 80° C.;

a colorant dispersing resin;

a colorant, and a release agent, wherein the toner has a glass transition temperature (Tg1st) of 20° C. to 50° C. where the glass transition temperature (Tg1st) is measured in first heating of differential scanning calorimetry (DSC) of the toner, wherein a tetrahydrofuran (THF) insoluble matter of the toner has a glass transition temperature [Tg2nd(THF insoluble matter)] of 30° C. or lower where the glass transition temperature [Tg2nd(THF insoluble matter)] is measured in second heating of differential scanning calorimetry (DSC) of the THF insoluble matter, and wherein 50% or less of the colorant is present within a region of 1,000 nm from a surface of each of the base particles toward a center thereof.

2. The toner according to claim 1, wherein a solution containing the colorant dispersing resin dissolved in ethyl acetate having a solid content of 20% by mass satisfies the expressions:

$$T(60)\%-T(480)\% \geq 30\%,$$

and $$T(480)\% \text{ is } 50\% \text{ or less},$$

where the T(60)% is a transmittance of the solution at an optical path length of 1 cm after the solution has been left for 60 minutes, and the T(480)% is a transmittance of the solution at an optical path length of 1 cm after the solution has been left for 480 minutes.

3. The toner according to claim 2, wherein the T(60) % is 30% or more.

4. The toner according to claim 1, wherein an amine value of the colorant is 2 mgKOH/g or less.

5. The toner according to claim 1, wherein the colorant comprises Pigment Red 269.

6. The toner according to claim 1, wherein a [G'(100) (THF insoluble matter)] is $1.0\times10^5$ Pa to $1.0\times10^7$ Pa where the [G'(100) (THF insoluble matter)] is a storage modulus at 100° C. of the THF insoluble matter.

7. The toner according to claim 1, wherein a ratio of [G'(40) (THF insoluble matter)] to the [G(100) (THF insoluble matter) ], which is represented by [G'(40) (THF insoluble matter)]/[G'(100) (THF insoluble matter)], is 3.5×10 or less, where the [G'(40) (THF insoluble matter)] is a storage modulus at 40° C. of the THF insoluble matter and the [G'(100) (THF insoluble matter)] is a storage modulus at 100° C. of the THF insoluble matter.

8. The toner according to claim 1, wherein the toner has a glass transition temperature (Tg2nd) of 0° C. to 30° C. where the glass transition temperature (Tg2nd) is measured in second heating of differential scanning calorimetry (DSC) of the toner.

9. The toner according to claim 6, wherein the [G'(100) (THF insoluble matter)] is $5.0\times10^5$ Pa to $5.0\times10^6$ Pa.

10. The toner according to claim 1, wherein the noncrystalline polyester resin A comprises a crosslinked structure.

11. A developer, comprising:

a toner: and a carrier, wherein the toner comprises:

base particles, comprising:

a noncrystalline nonlinear polyester resin (A) having at least one of a urethane and a urea bond and a glass transition temperature ($T_g$) of from −60° C. to 0° C.;

a noncrystalline polyester resin (B) having a $T_g$ of from 40 to 80° C.;

a crystalline polyester resin (C) having a melting point of from 60 to 80° C.;

a colorant dispersing resin;

a colorant, and a release agent, wherein the toner has a glass transition temperature (Tg1st) of 20° C. to 50° C. where the glass transition temperature (Tg1st) is measured in first heating of differential scanning calorimetry (DSC) of the toner, wherein tetrahydrofuran (THF) insoluble matter of the toner has a glass transition temperature [Tg2nd (THF insoluble matter)] of 30° C. or lower where the glass transition temperature [Tg2nd (THF insoluble matter)] is measured in second heating of differential scanning calorimetry (DSC) of the THF insoluble matter, and wherein 50% or less of the colorant is present within a region of 1,000 nm from a surface of each of the base particles toward a center thereof.

12. An image forming apparatus, comprising:

an electrostatic latent image bearer;

an electrostatic latent image forming unit configured to form an electrostatic latent image on the electrostatic latent image bearer; and a developing unit containing a toner and configured to develop the electrostatic latent image formed on the electrostatic latent image bearer with the toner to form a visible image, an image transfer device, and a fixing device, wherein the toner comprises:

base particles, comprising:

a noncrystalline nonlinear polyester resin (A) having at least one of a urethane and a urea bond and a glass transition temperature ($T_g$) of from −60° C. to 0° C.;

a noncrystalline polyester resin (B) having a $T_g$, of from 40 to 80° C.;

a crystalline polyester resin (C) having a melting point of from 60 to 80° C.;

a colorant dispersing resin;

a colorant, and a release agent, wherein the toner has a glass transition temperature (Tg1st) of 20° C. to 50° C. where the glass transition temperature (Tg1st) is measured in first heating of differential scanning calorimetry (DSC) of the toner, wherein tetrahydrofuran (THF) insoluble matter of the toner has a glass transition temperature [Tg2nd (THF insoluble matter)] of 30° C. or lower where the glass transition temperature [Tg2nd (THF insoluble matter)] is measured in second heating of differential scanning calorimetry (DSC) of the THF insoluble matter, and wherein 50% or less of the colorant is present within a region of 1,000 nm from a surface of each of the base particles toward a center thereof.

13. The toner of claim 1, wherein non-crystalline polyester resin A comprises a trihydric or higher aliphatic alcohol as a constituent component.

14. The toner of claim 1, wherein an amount of the non-crystalline polyester resin A is from 5 parts by mass to 25 parts by mass relative to 100 parts by mass of the toner.

15. The toner of claim 1, wherein the non-crystalline polyester resin B comprises a dicarboxylic acid component as a constituent component, and the dicarboxylic acid component comprises 50% by mole or more of an aromatic dicarboxylic acid.

16. The toner of claim 1, wherein an amount of the non-crystalline polyester resin B is from 50 parts by mass to 90 parts by mass, relative to 100 parts by mass of the toner.

17. The toner of claim 1, wherein an amount of the crystalline polyester resin C is from 3 parts by mass to 20 parts by mass, relative to 100 parts by mass of the toner.

* * * * *